US006041754A

United States Patent [19]

Mori et al.

[11] Patent Number: 6,041,754

[45] Date of Patent: Mar. 28, 2000

[54] IDLE INTAKE CONTROL DEVICE

[75] Inventors: Katsuyuki Mori; Kiyohiko Watanabe; Yasuyuki Kawabe, all of Nishio; Koichi Gomi; Takashi Fukunaga, both of Toyota; Tadashi Akiyama, Okazaki, all of Japan

[73] Assignees: Nippon Soken, Inc., Nishio; Toyota Jidoshi Kabushiki Kaisha, Toyota, both of Japan

[21] Appl. No.: 09/059,378

[22] Filed: Apr. 14, 1998

[30] Foreign Application Priority Data

| | | | |
|---|---|---|---|
| Apr. 14, 1997 | [JP] | Japan | 09-111885 |
| Jun. 11, 1997 | [JP] | Japan | 09-154011 |
| Jun. 16, 1997 | [JP] | Japan | 09-158754 |
| Jan. 19, 1998 | [JP] | Japan | 10-022663 |

[51] Int. Cl.[7] ..... F02D 41/16

[52] U.S. Cl. ..... 123/339.23; 123/585; 123/339.1

[58] Field of Search ..... 123/184.54, 339.1, 123/339.23, 339.25–339.28, 585

[56] References Cited

U.S. PATENT DOCUMENTS

| | | | |
|---|---|---|---|
| 4,840,159 | 6/1989 | Matsumoto | 123/585 |
| 5,704,335 | 1/1998 | Akutagawa et al. | 123/339.23 X |

FOREIGN PATENT DOCUMENTS

| | | |
|---|---|---|
| 2-7369 | 1/1990 | Japan . |
| 2-37271 | 3/1990 | Japan . |
| 2-233815 | 9/1990 | Japan . |
| 2-233817 | 9/1990 | Japan . |
| 4-1467 | 1/1992 | Japan . |
| 6-101604 | 4/1994 | Japan . |

*Primary Examiner*—Tony M. Argenbright
*Attorney, Agent, or Firm*—Pillsbury Madison & Sutro LLP

[57] ABSTRACT

An idle intake control device provided with a backflow preventing means for preventing a backflow near an idle intake regulating valve and producing only a forward flow in order to prevent idle intake air containing combustion products from flowing back and being adhered to an idle intake regulating valve in an idle intake passageway for bypassing an intake regulating valve provided in an intake passageway of the engine.

19 Claims, 18 Drawing Sheets

IDLE INTAKE CONTROL DEVICE

BACKGROUND OF THE INVENTION

1. Field of the Invention

The present invention relates to an idle intake control device for controlling an amount of intake air at the time of idling of an internal combustion engine.

2. Description of the Related Art

It has been known to arrange an idle intake control device in an intake system of an internal combustion engine to adjust the flow rate of the intake air at the time of idling (refer to for example Japanese Unexamined Patent Publication (Kokai) No. 4-1467). Such a first related art is shown in FIG. 1 and FIG. 2. In FIG. 1, air is fed to an engine 1 from the outside through an intake pipe 21 and intake chamber 22. The intake chamber 22 has a number of intake tubes 22*a*, equal to the number of cylinders of the engine, communicates with the cylinders of an engine 1 like a multi-cylinder gasoline engine. The space in the intake pipe 21 and the intake chamber 22 forms an intake passageway 2. The air from the outside is adjusted in amount by an intake regulating valve (throttle valve) 3 disposed in this intake passageway 2 and sucked into the cylinders of the engine 1.

The intake passageway 2 is also provided with a bypass connecting the upstream side and downstream side of the intake regulating valve 3. This is used as an idle intake passageway 4 at the time of engine idling when the intake regulating valve 3 is fully closed. In the middle of this idle intake passageway 4, an idle intake regulating valve 5 is disposed. The idling speed is precisely adjusted by finely adjusting the amount of the flow rate of the intake air fed to the engine 1 through the idle intake passageway 4.

The idle intake passageway 4 is usually formed inside a thick part of the wall of the intake passageway 2 as shown in FIG. 2, and is frequently of a bent shape or with step differences. Accordingly, in general, a vortex is apt to be generated due to a change of the passageway area downstream of the idle intake regulating valve 5. Similarly, if there is a step difference where the passageway diameter expands in the direction of advance of intake air in the idle intake passageway 4 downstream of the idle intake regulating valve 5, a vortex is generated downstream of the step. In the configuration of FIG. 2, step portions 61 and 62 exist downstream of the idle intake regulating valve 5. The passageway diameter changes considerably before and after the same. As indicated by the arrows in FIG. 2, vortices 7-1 and 7-2 are apt to be generated immediately after the idle intake regulating valve 5 and immediately after the step portions 61 and 62, respectively.

On the other hand, in FIG. 1, the combustion products stagnate in the intake chamber 22 downstream of the intake regulating valve 3 due to the blowback from the engine 1. There is a problem that the combustion products invade the idle intake passageway 4 due to the pulsation in the intake chamber 22 and the vortexes 7 shown in FIG. 2. Namely, the combustion products enter near the outlet of the idle intake passageway 4 due to the pulsation in the intake chamber 22 when the intake regulating valve 3 is opened wide. Further, if the vortexes 7 shown in FIG. 2 are generated in the idle intake passageway 4 when the intake regulating valve 3 is substantially fully closed, they ride on them and flow back in the idle intake passageway 4. Then, the combustion products are apt to adhere to the idle intake regulating valve 5.

Next, a second related art of the idle intake control device is shown in FIG. 3. In this example, a door-shaped idle intake regulating valve 5 forming a clearance by rotating or moving forward or backward in the axial direction is provided in the idle intake passageway 4 formed in the bypass passageway of the throttle valve 3. Air passes through the clearance and controls the idling speed of the engine (refer to Japanese Unexamined Patent Publication (Kokai) No. 6-101604, Japanese Unexamined Utility Model Publication (Kokai) No. 2-7369, or Japanese Unexamined Patent Publication (Kokai) No. 2-233815).

When an engine provided with such an idle intake control device of the related art is operated, the combustion products such as carbon 6 in the intake chamber 22 are carried by a backflow 8 going toward the idle intake regulating valve 5 through the idle intake passageway 4 and are adhered to and deposited on the intake regulating valve 5 as indicated by 13 in FIG. 3. As a result, the flow path for the flow of air indicated as a forward flow 9 is narrowed. There is a possibility of error in the control of the flow rate as a result. In this case, if a maze-like narrow passageway part is provided at the downstream side of the intake regulating valve, not only will the flow of the idle intake be prevented, but also the combustion products will clog at the maze part and the passageway will easily become blocked.

Further, as a third related art, as in the idle intake control device 11 in the gasoline engine 1 shown in FIG. 4, a state of low load operation is shown, in which the throttle valve 3 is slightly open. Most of the intake air will pass through the upper and lower clearances 2*a* and 2*b* formed between the upper and lower circumferential edges 3*a* and 3*b* far away from the shaft 14 of the disk-like throttle valve 3 and the inner wall surface of the intake passageway 2. Additionally, the air flow will follow the flow lines 15 indicated by the arrows, and flow into the intake chamber 22. The upstream part of the idle intake passageway 4 from the idle intake regulating valve 5 is indicated as 4*a*. Additionally, the part of the idle intake passageway 4 up to an opening 16 at the terminal end at the downstream side from the idle intake regulating valve 5 is indicated as 4*b*. Since the opening 16 is provided in the wall surface of the intake passageway 2 at a position near the clearance 2*b* formed when the throttle valve 3 is slightly opened as in FIG. 4, one part of the intake air passing through the clearance 2*b* will not flow to the downstream side of the intake passageway 2. This part of the intake air will flow into the part 4*b* of the idle intake passageway 4 on the downstream side from the opening 16 as indicated by the flow line 17 marked by the arrow, and will further pass through the opening idle intake regulating valve 5, and flow back toward the upstream side part 4*a*.

In the intake chamber 22 of the engine 1, combustion products such as the carbon particles, are generated in the combustion chamber due to the blowback of combustion gas from combustion chamber to the intake chamber 22. This causes in a specific operational state and exhaust gas recirculation (EGR) is carried out for purification of the exhaust, always exist in a floating state or a state of unstable adhesion to the inner surface of the wall. Therefore, if part of the backflow 17 of intake air is produced in the idle intake passageway 4 as mentioned above, the combustion products existing in the intake chamber 22 will ride the backflow 17 and reach the idle intake regulating valve 5 where they will adhere. Thus, they are apt to reduce the controllability of the idle intake regulating valve 5.

Further, to explain a more general problem of the related art, a fourth related art of the intake system of the engine is shown in FIG. 5 and FIG. 6. In the same way as the above related art, external air 10 is sucked into the engine 1 through an intake pipe 21 and intake chamber 22 so as to maintain the rotation of the engine. An intake regulating valve 3 is disposed in the intake pipe 21 to regulate the amount of intake air. Further, in order to hold the amount of intake air at the time of idling when this intake regulating valve 5 is fully closed, for example, the idle intake control device 11 disclosed in Japanese Unexamined Patent Publication (Kokai) No. 2-233817 is disposed.

The idle intake control device 11 is provided with, as shown in FIG. 6, an idle intake passageway 4 for connecting the upstream side and downstream side of the intake regulating valve 3 like the throttle valve and with an idle intake regulating valve 5 disposed in the middle of the same. In this case as well, when the intake regulating valve 3 is fully closed, intake air adjusted in amount by the idle intake regulating valve 5 is introduced into the intake chamber 22 through the idle intake passageway 4, is sucked into the engine 1 at the time of opening of the intake valve 12, and maintains the idling state.

In such an idle intake control device, generally there is a problem in that the combustion products of the engine 1 invade the idle intake passageway 4 due to the pulsation of the intake pressure in the intake chamber 22 when the intake regulating valve 3 is opened wide. Namely, when the intake regulating valve 3 becomes substantially fully open as shown in FIG. 6, the forward direction flow going from the upstream side to the downstream side in the idle intake passageway 4 dwindles to substantially zero. For this reason, in the idle intake passageway 4, a reciprocal direction flow as indicated by the arrows is generated due to the pulsation-like flow of intake air in the intake pipe 21. Due to this flow, the combustion products in the intake chamber 22 are liable to invade the internal portion of the idle intake passageway 4 from the outlet side thereof due to the blowback from the engine 1, flow back, and adhere to the idle intake regulating valve 5.

SUMMARY OF THE INVENTION

An object of the present invention is to provide an improved idle intake control device capable of dealing with these problems in the related art and capable of preventing the carbon and other combustion products from adhering to the idle intake regulating valve provided in the idle intake passageway.

The present invention provides an idle intake control device disclosed in the claims as a means for achieving this object.

The idle intake control device of the present invention, is provided with at least one backflow preventing means for preventing the backflow of the idle intake air in the idle intake passageway near the idle intake regulating valve to producing only a forward flow of the idle intake air near the idle intake regulating valve without substantially inhibiting the flow of the idle intake air. By this, it is possible to prevent the idle intake air near the outlet opening of the idle intake passageway from flowing back in the idle intake passageway along with the combustion products and reaching the idle intake regulating valve and thereby prevent the combustion products from adhering to the idle intake regulating valve.

In a second configuration, a restrictor portion is provided in the idle intake passageway downstream of the idle intake regulating valve. In addition, the inner wall surface of the restrictor portion and the inner wall surface of the idle intake passageway upstream and downstream thereof are connected by a smooth surface not having a step difference.

In the above configuration, since a restrictor portion is provided in the idle intake passageway, due to a flow resistance at this restrictor portion, invasion of a pulsating flow when the engine is operating at high load is suppressed. Further, since the restrictor portion is given a shape not having a step difference before and after this, no vortex is produced due to the provision of the restrictor portion. Even if a vortex is generated downstream of the idle intake regulating valve, it is rectified by the restrictor portion, so the vortex does not expand up to the downstream area of the restrictor portion. Accordingly, the generation of a backflow in the idle intake passageway is suppressed and there is an effect that the flow of intake air, accelerated when passing through the restrictor portion, prevents the invasion of the combustion products to the upstream side from the restrictor portion, so it is possible to prevent the combustion products from reaching the idle intake regulating valve and prevent the adhesion of the combustion products.

In a third configuration of the present invention, the restrictor portion is shaped to gradually expand in diameter toward the upstream and downstream sides from the minimum diameter portion at the approximate center. By adopting such a shape, it is possible to easily realize a restrictor portion maintaining a rectification effect by throttling and an effect of prevention of invasion of the pulsating flow and in addition not having a step difference.

In a fourth configuration of the present invention, in the restrictor portion, the angle of inclination of the wall surface at the upstream side of the minimum diameter portion is made larger than the angle of inclination of the wall surface at the downstream side. By making the angle of inclination at the upstream side larger, it is possible to make the speed of the flow of intake air passing through the restrictor portion high and enhance the effect of preventing the invasion of the combustion products. Further, preferably the angle of inclination at the downstream side is made smaller than this so that the flow downstream of the restrictor portion is not disturbed due to this high speed flow of intake air.

In a fifth configuration of the present invention, the sectional area of passageway of the minimum diameter portion is set to 80% or less of the smaller passageway sectional area between the passageway sectional areas of the idle intake passageway upstream and downstream thereof and then more than the maximum opening surface area of the idle intake regulating valve. Within this range, the above effect of the provision of the restrictor portion is obtained. In addition, the required amount of intake air can be secured at the time of idling.

In a sixth configuration of the present invention, the position of the minimum diameter portion is set so that the distance x [mm] of the center trace of the passageway cross section from the minimum diameter portion to the downstream end portion of the idle intake passageway becomes equal to or larger than $1.5 \cdot \Delta p$ when the maximum intake pulsation width in the intake passageway downstream of the intake regulating valve is defined as $\Delta p$[kPa]. At this time, by securing a distance more than the amplitude of the combustion products due to the pulsation downstream of the restrictor portion, it is possible to prevent the combustion products from invading upstream from the restrictor portion.

In a seventh configuration of the present invention, the entire inner wall surface of the idle intake passageway downstream of the intake regulating valve is constituted by a smooth surface not having any step differences or angle portions. By this, the generation of a vortex is further suppressed, so the effect of preventing the backflow is improved.

In an eighth configuration of claim 8, in order to achieve the above object, the present invention provides an accumulation chamber in which the carbon and other combustion products can be accumulated in the idle intake passageway from the intake chamber to the intake regulating valve in the idle intake control device. More concretely, in the ninth through twelfth configurations, the present invention provides an accumulation chamber housing a metal sphere so that it can tumble there, pulverizes the accumulated combustion products, and returns the result to the intake chamber side or replaces the accumulation chamber with a chamber in which the combustion products have not yet accumulated.

Since the idle intake control device disclosed in the eighth to twelfth configurations has the means described above, the combustion products contained in the idle intake air accumulate in the accumulation chamber and are pulverized by the metal sphere before flowing back in the idle intake passageway, serving as the bypass passageway of the throttle valve, and adhering to the intake regulating valve. Therefore, the now particulate combustion products ride the forward flow of the idle intake air and are sucked and returned to the intake chamber. Accordingly, the combustion products can be prevented from adhering to and depositing on the intake regulating valve. Therefore the idle intake passageway is no longer narrowed and error of the control of the flow rate can be eliminated. Note that even if the accumulation chamber per se is replaced when the combustion products accumulate in the accumulation chamber, a similar effect can be obtained.

Further, the present inventors engaged in repeated experiments, evaluations, and studies on the positional relationship between the opening of the idle intake passageway and the intake regulating valve of the intake passageway, that is, the throttle valve, and as a result found some new facts. They consequently developed and provided idle intake control devices having the thirteenth to fifteenth configurations.

In the idle intake control device of the present invention disclosed in thirteenth configuration, the opening of the end of the idle intake passageway is provided at a position which becomes the downstream side of the throttle valve at the time of a constant valve opening angle θ which is the limit for not causing a backflow in the idle intake passageway. Therefore, the combustion products generated due to combustion in the combustion chamber of the engine are prevented from intruding from the opening of the end of the idle intake passageway and flowing back in the idle intake passageway. Accordingly, adhesion of the combustion products to the idle intake regulating valve and deterioration of idling speed adjustment can be prevented before occurrence.

According to a fourteenth configuration, the constant opening angle θ of the limit for the intake regulating valve, that is, the throttle valve, not causing a backflow in the idle intake passageway can be set to an angle rotated by substantially exactly 45° when seen from the fully closed position of the throttle valve. Further, the opening position of the opening of the end of the idle intake passageway can be located at the downstream side of the shaft of the throttle valve. Further, according to the fifteenth configuration, the opening of the end of the idle intake passageway is provided in a preferred area defined as the position which becomes the downstream side of the throttle valve, therefore it is also possible to form the opening deformed along the throttle valve.

In a sixteenth configuration of the present invention, a standing wall is provided projected out from an edge portion on the downstream side of the opening portion provided in the intake passageway wall at the upstream side of the intake regulating valve into the intake passageway and guiding part of the intake air flowing in the intake passageway into the idle intake passageway.

According to the above configuration, part of the flow of intake air in the intake passageway strikes the standing wall, changes in direction, and is introduced into the idle intake passageway from the opening portion along the standing wall. In this way, a forward direction flow of intake air going from upstream to downstream can be always formed in the idle intake passageway, therefore even in a case where the intake regulating valve is substantially fully open, this forward direction flow can prevent the combustion products of the engine from invading the idle intake passageway. Accordingly, it is possible to prevent the combustion products from flowing back in the idle intake passageway, reaching the idle intake regulating valve, and adhering there.

In a seventeenth configuration of the present invention, the standing wall is disposed so as not be parallel to the flow of intake air in the intake passageway. By this, the effective area of the standing wall receiving the flow of intake air becomes large, therefore there is a large effect of forming the forward direction flow of intake air in the idle intake passageway and the invasion of the combustion products can be reliably prevented.

As in an eighteenth configuration of the present invention, it is also possible to provide an opening acting as an intake inlet to the idle intake passageway and to provide a wall portion which projects out from the edge of the opening portion, except the part on the upstream side, into the intake passageway and covers the sides and top of the opening portion on the downstream side.

In the above configuration, part of the flow of the intake air in the intake passageway is introduced from the upstream side opening of the wall portion to the internal portion thereof and further guided to the idle intake passageway from the opening portion. Accordingly, by this configuration, a forward direction flow of intake air can be always formed in the idle intake passageway. Further, since the sides and top of the opening portion are covered, the effect of branching the intake air becomes high and the effect of preventing the invasion of the combustion products becomes large.

As shown in a nineteenth configuration of the present invention, it is also possible to form a concave portion inclined downward toward the downstream side in the intake passageway wall at the upstream side of the intake regulating valve and provide an opening portion acting as the intake inlet to the idle intake passageway at the bottom of the concave portion.

In the above configuration, part of the flow of intake air in the intake passageway is guided to the concave portion, moves toward the opening portion provided in the bottom portion thereof, and is introduced into the idle intake passageway. Accordingly, by the above configuration as well, a forward direction flow of intake air can be always formed in the idle intake passageway and it is possible to prevent the combustion products from intruding into the idle intake passageway, flowing back, and adhering to the idle intake regulating valve.

In a twentieth configuration of the present invention, the width of the inclined surface of the concave portion is made broader toward the upstream side. By this, a larger amount of intake air can be guided into the concave portion, so the invasion of the combustion products can be reliably prevented.

BRIEF DESCRIPTION OF THE DRAWINGS

These and other objects and effects of the present invention will be more apparent from the following preferred embodiments explained in detail with reference to the accompanying drawings, wherein.

DESCRIPTION OF THE PREFERRED EMBODIMENTS

Figure 7:
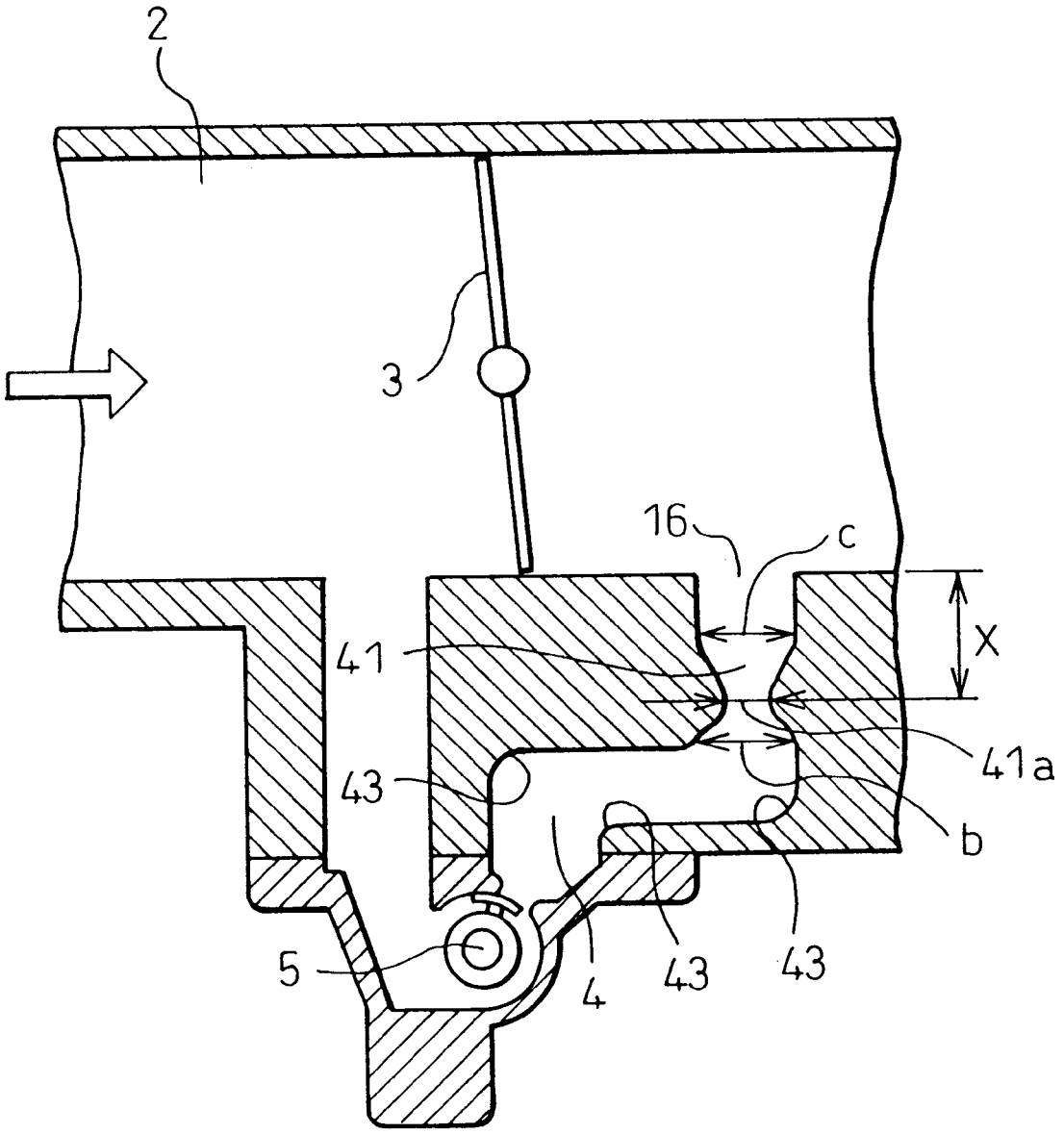
FIG. 7 is a vertical sectional front view of a first embodiment of the present invention.

FIG. 7 shows a first embodiment of the present invention. In FIG. 7, an intake regulating valve (throttle valve) 3 for regulating the amount of intake air fed to an engine (not shown) is disposed in the intake passageway 2. The intake air flows in the intake passageway 2 as indicated by the arrow from the left to right of FIG. 7, passes through the intake regulating valve 3, and is then sucked into the engine through the passageway in the not illustrated intake chamber.

The intake passageway 2 is basically rectangular in cross-section, however, may be circular in cross-section too.

In the intake passageway 2, part of the passageway wall is formed thick in the vicinity of the intake regulating valve 3. Here, an idle intake passageway 4 having a schematically U-shape is provided as a bypass passageway for connecting the upstream side and downstream side of the intake regulating valve 3. In an intermediate portion of the idle intake passageway 4, the idle intake regulating valve 5 for regulating the intake amount at the time of idling is disposed.

In the present invention, a restrictor portion 41 for rectifying the flow of the idle intake air in the passageway and, at the same time, suppressing backflow is provided in the idle intake passageway 4 at a position on the downstream side of the idle intake regulating valve 5. This restrictor portion 41 is shaped to gradually expand in diameter toward the upstream side and downstream side from the minimum diameter portion 41*a* at the approximate center and is constituted so that the inner wall surface of the restrictor portion 41 and the inner wall surface of the idle intake passageway 4 on the upstream and downstream thereof are connected by a smooth surface not having a step difference.

Here, the restrictor portion 41 is formed so that the angle of inclination of the wall surface on the downstream side of the minimum diameter portion 41*a* becomes moderate with respect to the angle of inclination of the wall surface at the upstream side. When the angle of inclination at the upstream side is large, the flow passing through the restrictor portion is apt to be accelerated, therefore the effect of preventing invasion of combustion products is increased. Preferably, the diameter gently expands on the downstream side along the flow of intake air.

The restrictor portion 41 is usually formed so that the sectional area of the passageway of the minimum diameter portion 41*a* is 80% or less of the smaller surface area between a passageway sectional area b of the idle intake passageway 4 on the upstream side thereof and a passageway sectional area c on the downstream side and then becomes more than the maximum opening surface area of the idle intake regulating valve 5. By making the passageway sectional area of the minimum diameter portion 41*a* larger than the maximum opening surface area of the idle intake regulating valve 5, a sufficient amount of intake air can be secured in the idling state. Further, in practice, to obtain a sufficient rectification effect, desirably the passageway sectional area of the minimum diameter portion 41*a* is set to 80% or less of the passageway sectional areas b and c of the idle intake passageway 4. Accordingly, preferably the passageway sectional area of the minimum diameter portion 41*a* is appropriately set so that the minimum required flow rate is secured within above range. Note that, when the intake passageway in an actual engine was visualized by using a carbon tracer and the range of the restrictor portion in which the combustion products, that is, the carbon, did not flow back was examined, it was found that the invasion of carbon to the upstream side from the restrictor portion could be substantially prevented when the sectional area of the restrictor portion was 80% or less.

Further, preferably the position of the minimum diameter portion 41*a* is set so that the distance x [mm] from the minimum diameter portion 41*a* to the opening 16 at the downstream side of the idle intake passageway becomes equal to or larger than 1.5·Δp where the maximum intake pulsation width in the intake passageway 2*a* at the downstream side of the intake regulating valve 3 is Δp[kPa]. Here, the distance x is set to the distance at the trace at the center of the passageway cross section. Usually, the particles of carbon etc. have a high density in comparison with air, therefore the lower the pulsation frequency, the larger the amplitude with respect to the equivalent air pulsation. In an automobile engine, the frequently used speed is about 2000 rpm. When the correlation between the pulsation width Δp at this time and the amplitude L of the reciprocal movement of the combustion products, that is, carbon, was examined, it was clarified that a relationship of L=1.5·Δp substantially stood. Accordingly, when x is set to be equal to or larger than L, a distance of at least the amplitude of the combustion products caused by the pulsation in the intake passageway 2*a* can be secured at the downstream side of the restrictor portion, and the invasion of combustion products to the upstream side of the restrictor portion 41 can be prevented.

Note that preferably the idle intake passageway 4 is constituted so that the entire inner wall surface of the passageway downstream of the idle intake regulating valve 5 is constituted by a smooth surface not having any step difference or angle portion. In the present embodiment, a bent portion 43 of the passageway is formed as a curved surface so as to further enhance the rectification function.

According to the above configuration, the invasion of the combustion products to the upstream side of the restrictor portion 41 due to the pulsation in the intake chamber is suppressed by the flow resistance in the restrictor portion 41. Further, by setting the restrictor portion 41 at a proper position, the above effects can be more effectively exhibited. Further, since no step difference is formed before and after the restrictor portion 41, no vortex is generated due to the restrictor portion 41 and, further, the invasion of the combustion products flowing back from the intake chamber due to the accelerated flow of intake air passing through the restrictor portion 41 can be prevented. In addition, since a configuration not having a step difference or angle portion is given to the entire passageway at the downstream side of the idle intake regulating valve 5, almost no vortexes occur. Even if one occurs, the spread of the vortex further downstream can be prevented by the rectification effect of the restrictor portion 41.

Next, a detailed explanation will be made of the point of connecting the inner wall surface of the restrictor portion 41 formed in the idle intake passageway 4 and the inner wall surfaces at the upstream side and downstream side thereof by a smooth surface not having a step difference. The formation of the restrictor portion 41 by a "smooth surface without a step difference" means that in a case such as the shape of the restrictor portion 41 shown in FIG. 7, the primary derivative of the curve indicating the contour of the sectional shape of the restrictor portion is continuous.

Figure 8:
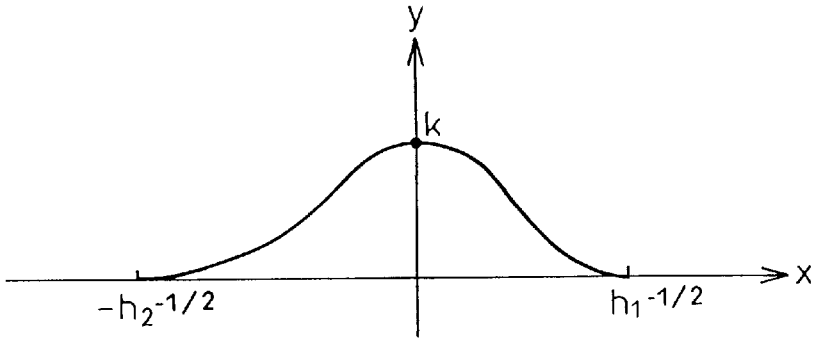
FIG. 8 is a graph explaining a concrete example of the first embodiment.

As the curves for forming the cross section of the restrictor portion 41, it is possible to use curves of higher order functions such as third order functions or higher. It is possible to use not only curves of single higher order functions, but also curves obtained by combining a plurality of curves if they are connected so that the primary derivative is continuous at the connection. Giving an example of that case, where k, $h_1$, and $h_2$ are any numerical values, a case of connecting parts of two curves drawn by two fourth order function formulas:

$$y=k(h_1x^2-1)^2\ (0\leqq x\leqq h_1^{-1/2}) \tag{1}$$

$$y=k(h_2x^2-1)^2\ (-h_2^{-1/2}\leqq x<0) \tag{2}$$

at a point where x=0 and y=k and using the combined curve as a contour curve of the cross section of the restrictor portion 41 is shown in FIG. 8. By rotating such a contour curve around an x-axis shown in FIG. 8, a smooth surface without a step difference of the restrictor portion 41 can be obtained.

Figure 9:
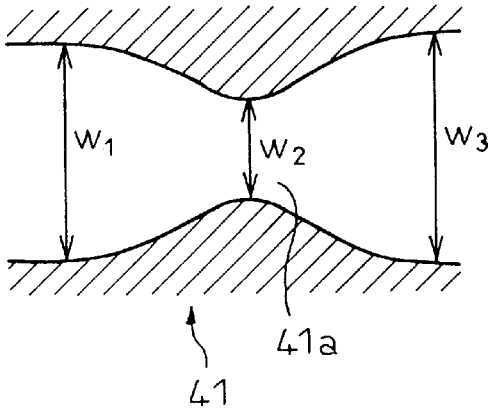
FIG. 9 is vertical sectional front view of a concrete example of the first embodiment.

Explaining this example more concretely, when the restrictor portion 41 having a shape as shown in FIG. 9 is formed, for example, where $h_1=1/9$, $h_2=1/4$, and k=1, two curves defined by:

$$y=[(x^2/9)-1]^2\ (0\leqq x\leqq 3) \tag{1}$$

$$y=[(x^2/4)-1]^2\ (-2\leqq x\leqq 0) \tag{2}$$

will be connected to each other, but where diameters $w_1$ and $w_3$ of the parts at the upstream side and downstream side of the restrictor portion 41 are defined as $w_1=w_3=6$, the diameter $w_2$ of the minimum diameter portion 41*a* becomes equal to 4, therefore the restriction rate in this case becomes:

$$w_2/w_1=0.67=67\%<80\%,$$

which is suited to the requirements of the present invention.

Figure 10:
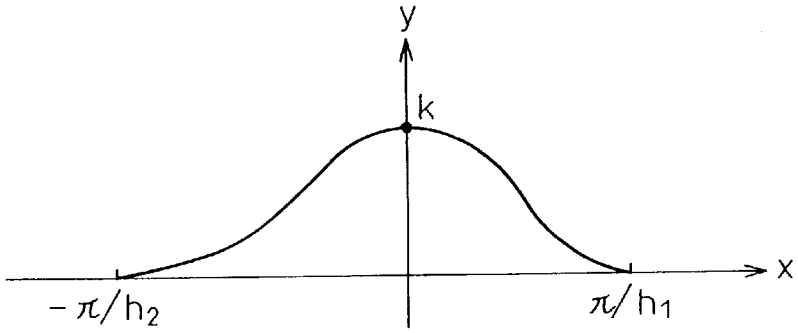
FIG. 10 is a graph explaining another concrete example of the first embodiment.

Next, an explanation will be made of a case of defining the curve for forming the cross section of the restrictor portion 41 by a trigonometric function as another example. A contour curve as shown in FIG. 10 is formed by connecting parts of curves of two trigonometric functions such as:

$$y=k[\cos(h_1x)+1]\ (0\leqq x\leqq \pi/h_1) \tag{3}$$

$$y=k[\cos(h_2x)+1]\ (-\pi/h_2\leqq x<0) \tag{4}$$

at the point where x=0 and y=k where k, $h_1$, and $h_2$ are again any numerical values. This is rotated around x to obtain a smooth curved surface of the restrictor portion 41 without a step difference.

Note that needless to say not only curves of such higher order functions and trigonometric functions, but also curves of other functions which can be utilized as the contour curves of the restrictor portion 41 exist. Further, the sectional shape of the restrictor portion 41 and the idle intake passageway 4 at the upstream side and downstream side thereof can be not only a circle, but also any flat shape. Therefore, in this case, $w_1$, $w_2$, and $w_3$ do not mean diameters, but mean widths of the passageways.

Thus, an idle intake control device capable of suppressing the generation of backflow toward the idle intake regulating valve 5 and of preventing the combustion products from being adhered to the idle intake regulating valve 5 and excellent in controlability can be realized.

Figure 11:
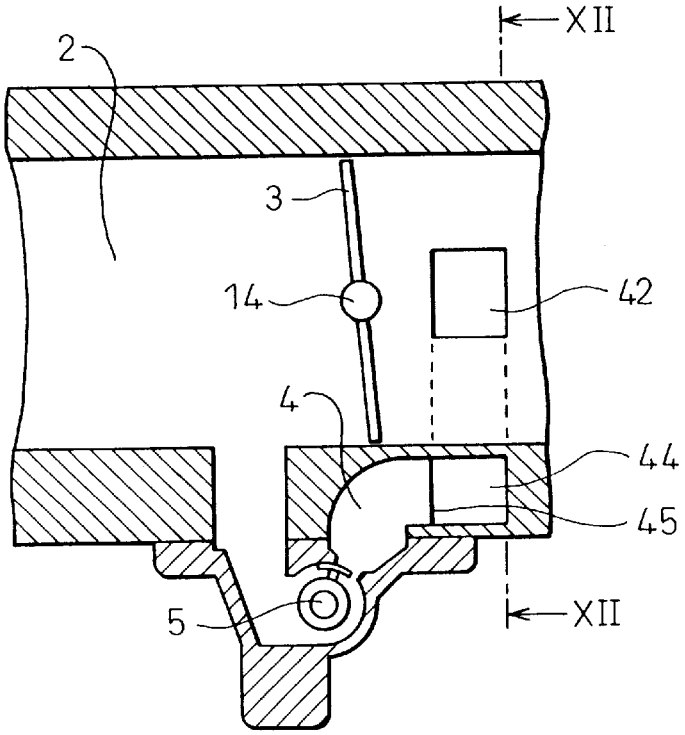
FIG. 11 is a vertical sectional front view of a second embodiment of the present invention.
Figure 12:
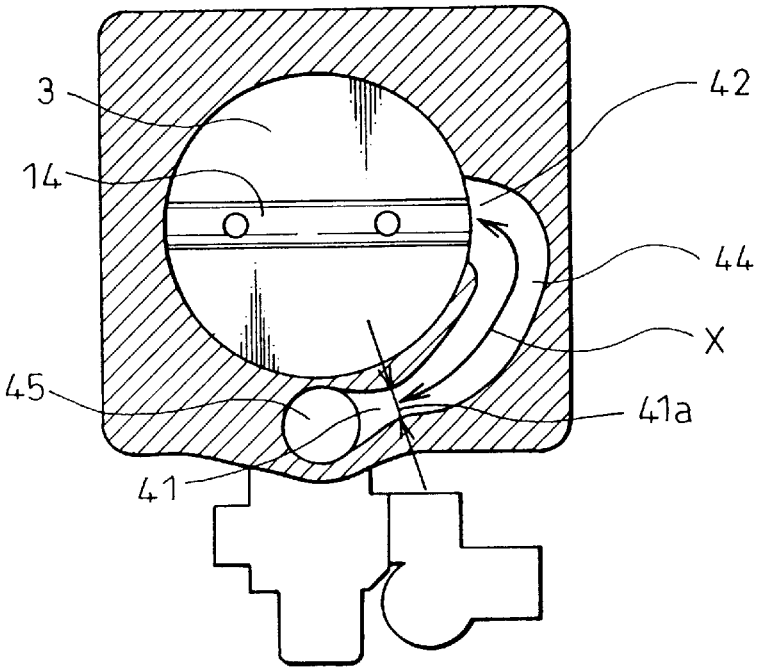
FIG. 12 is a lateral sectional side view of FIG. 11.

Next, FIGS. 11 and 12 show a second embodiment of the present invention. In the second embodiment, the idle intake passageway 4 is formed in a substantially arc shape along an outer circumference of the intake passageway 2 at a position at the downstream side of the idle intake regulating valve 5. The end thereof is bent in the diameter direction of the intake passageway 2 and opened as indicated by 42. The restrictor portion 41 is formed in this substantially arc-shaped passageway 44 so that the distance x between the minimum diameter portion 41*a* thereof and the opening 42 of the end portion at the downstream side of the idle intake passageway 4 (distance of center trace of the passageway cross section) and the sectional area of the minimum diameter portion 41*a* become within the predetermined range shown in the first embodiment.

According to the configuration of the second embodiment, the length of the idle intake passageway 4 can be made longer and the effect of suppressing the invasion of the combustion products is high. Further, by shaping the passageway in the form of an arc, the shape has a reduced step difference or angle portion, and is therefore excellent in the effect of preventing backflow.

Note that the idle intake passageway 4 of the above configuration can be easily formed by shaping the passageway parts before and after the idle intake regulating valve 5 and the substantially arc passageway 44 by casting and forming a through hole 45 for connecting the two.

Figure 13:
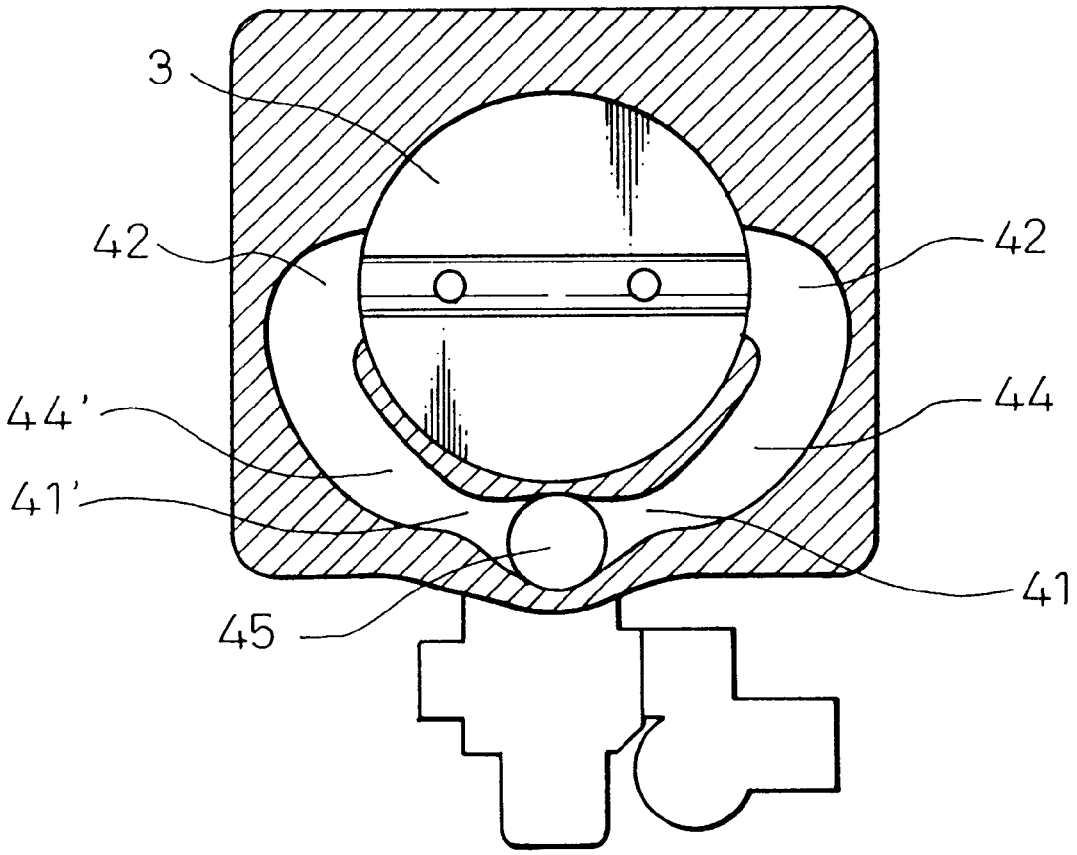
FIG. 13 is a lateral sectional side view of a third embodiment of the present invention.

In the above embodiments, the above effect is obtained if at least one the restrictor portions 41 is provided per idle intake passageway 4, but the number thereof is not particularly limited and can be plural as well. Further, it is also possible to provide a plurality of idle intake passageways 4 or branch this at the middle.

Where there are a plurality of idle intake passageways 4, at least one restrictor portion 41 is necessary for each passageway. An example thereof is shown as a third embodiment of the present invention in FIG. 13. In the third embodiment, the idle intake passageway 4 is branched at the middle to provide a similar schematically arc-shaped branch passageway 44' at a symmetrical position to the schematically arc-shaped passageway 44 of the second embodiment. Further, a restrictor portion 41' is also formed in this branch passageway 44' at almost the same position as the restrictor portion 41 of the passageway 44.

In this way, where a sufficient idle intake flow rate cannot be secured by only one idle intake passageway 4, the branch passageway 44' is provided in the idle intake passageway 4, whereby the total flow rate can be increased. Also in the above configuration, similar effects to those of the above embodiments are obtained by providing restrictor portions 41 and 41' in each intake passageway.

Figure 1:
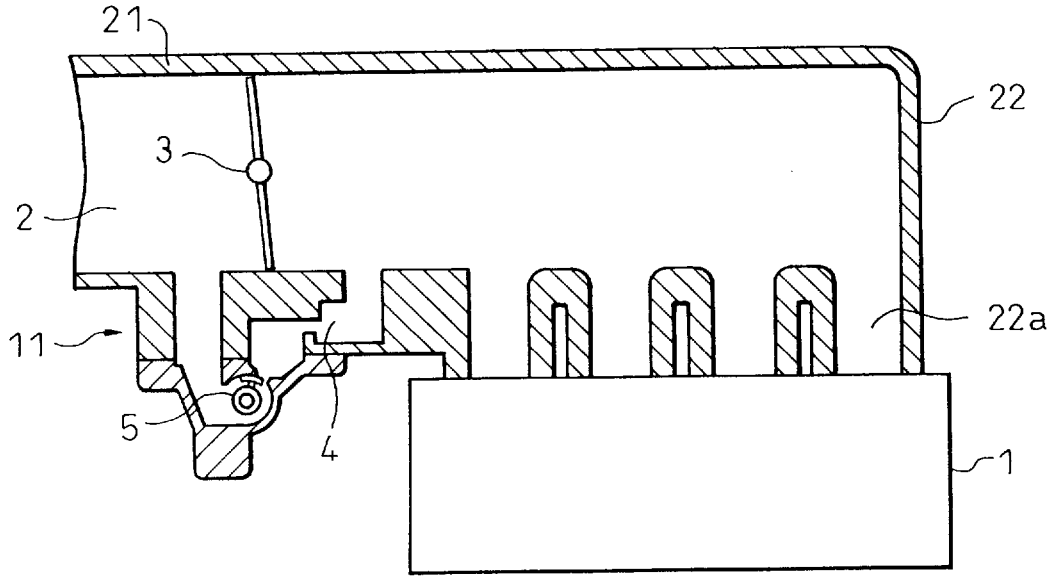
Fig.1 PRIOR ART
FIG. 1 is a vertical sectional front view of a first related art.
Figure 2:
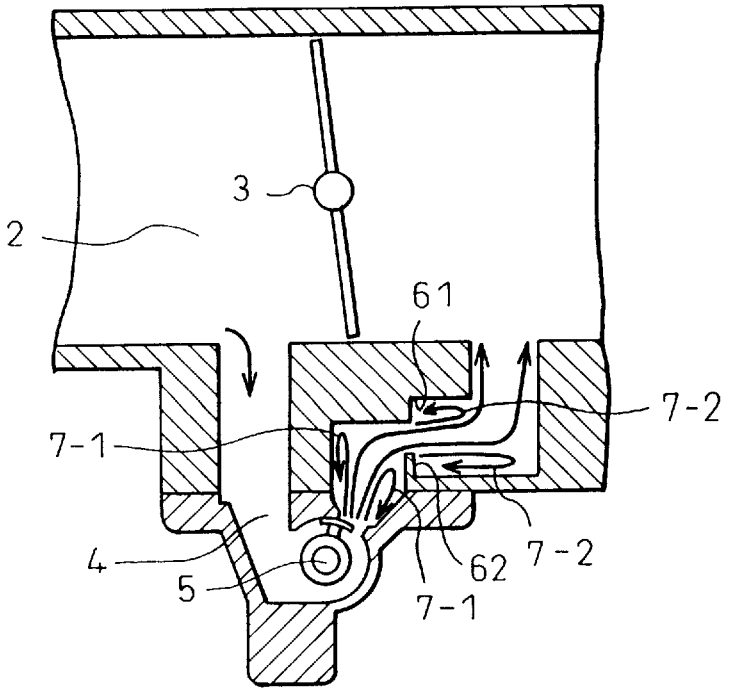
Fig.2 PRIOR ART
FIG. 2 is a vertical sectional front view of an enlarged part of FIG. 1.
Figure 3:
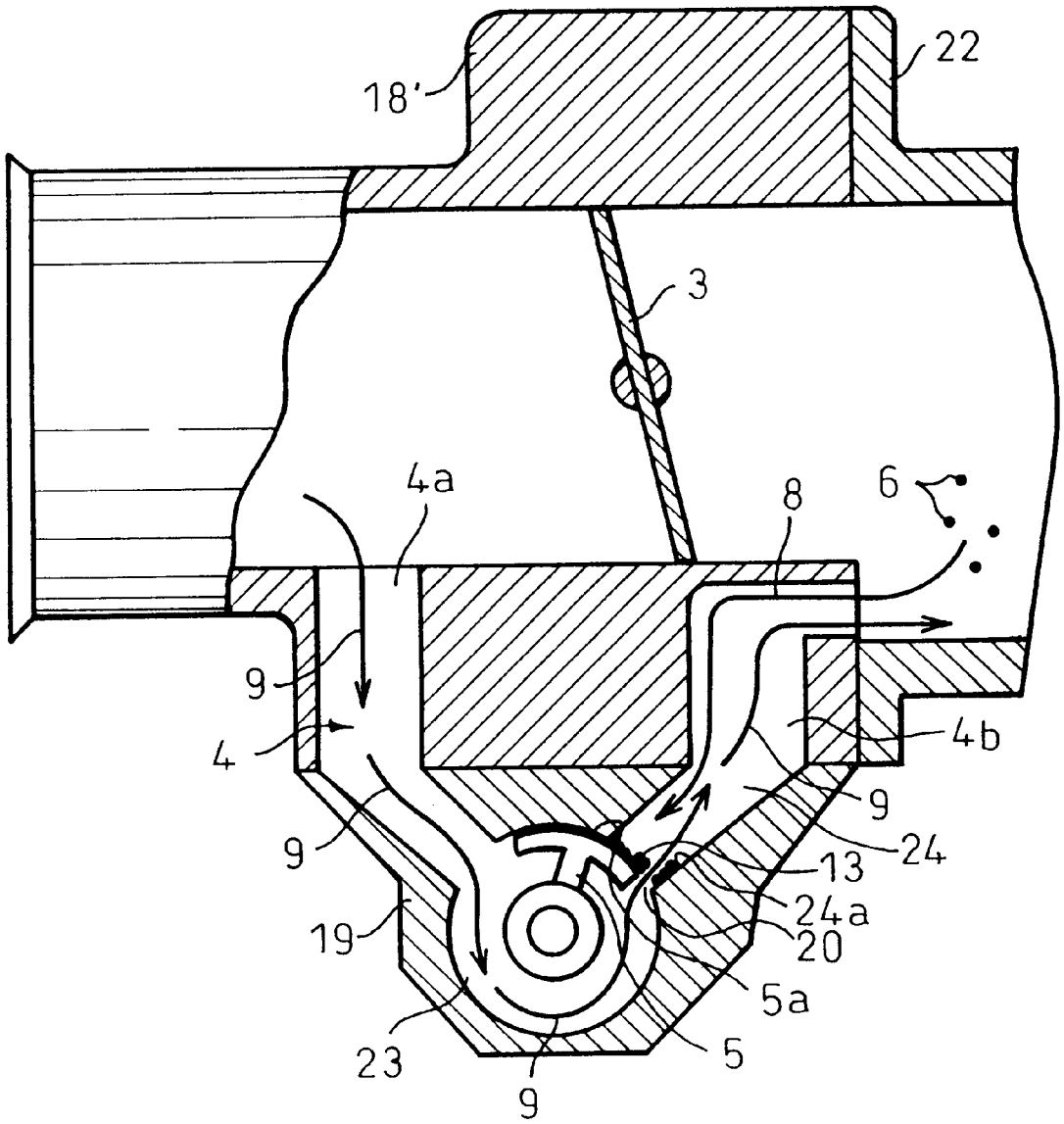
Fig. 3 PRIOR ART
FIG. 3 is a vertical sectional front view of a second related art.
Figure 14:
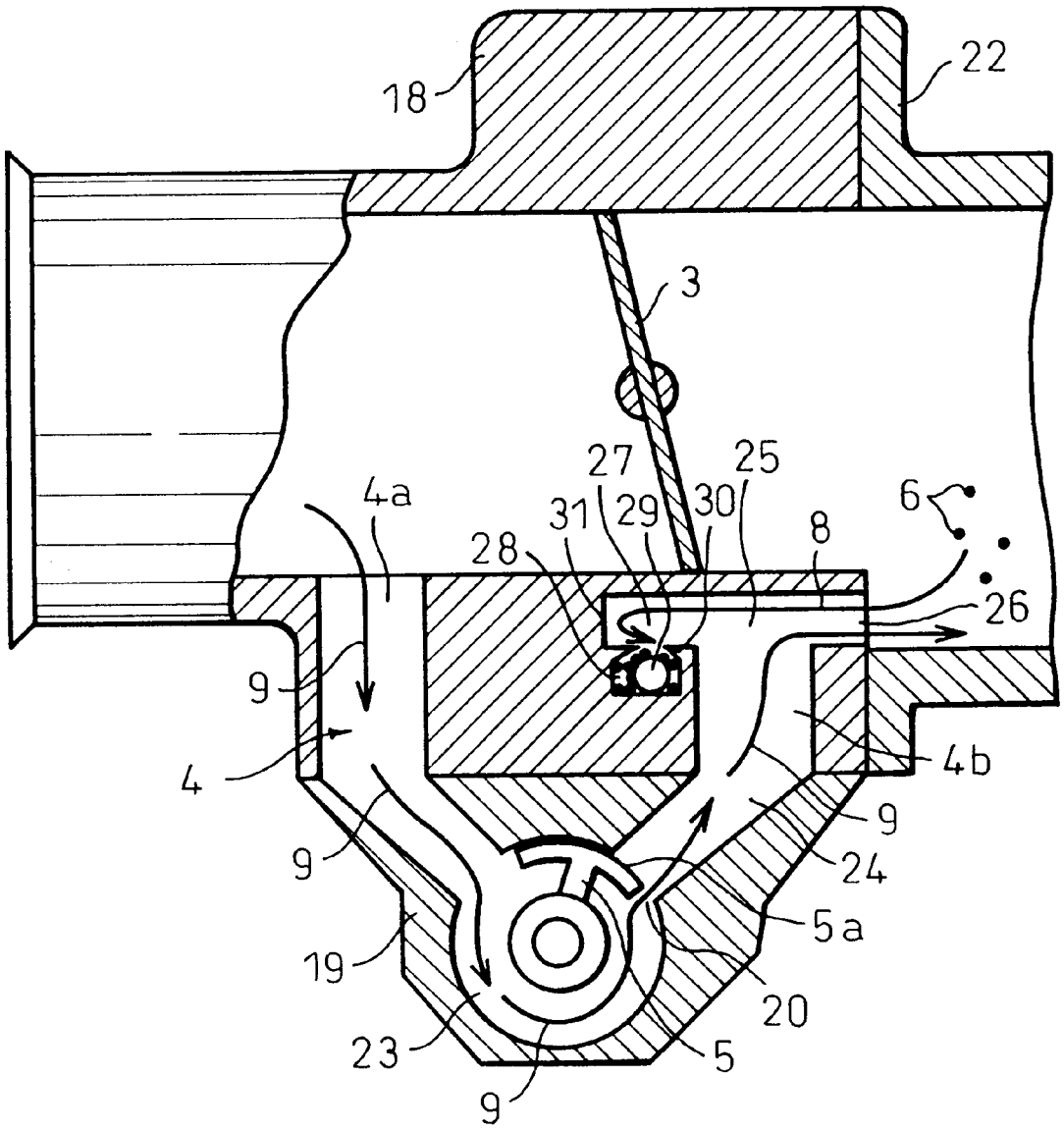
FIG. 14 is a lateral sectional side view of a fourth embodiment of the present invention.

Next, a fourth embodiment of the idle intake control device of the present invention will be concretely explained by referring to FIG. 14. The intake regulation mechanism of the related art to be compared with the fourth embodiment is shown in FIG. 3 as the second related art. First, in FIG. 3 showing the related art, 18' is a throttle body provided with a throttle valve (intake regulating valve) 11 and connected to the upstream side of the intake chamber 22. Reference numeral 19 is an idle intake regulating valve body attached to the throttle body 18'. Reference numeral 4 is the idle intake passageway formed in the throttle body 18' as the bypass passageway with respect to the throttle valve. In this example, in order to connect the upstream side and downstream side of the throttle valve 3, a first half portion 4*a* and latter half portion 4*b* of the idle intake passageway 4 are respectively connected by the cylindrical passageway 23 and outlet passageway 24 inside the idle intake regulating valve body 19. Reference numeral 5 is a idle intake regulating valve capable of pivoting in the cylindrical passageway 23, and 20 is a clearance formed by the idle intake regulating valve 5 and the outlet passageway 24. Note that the direction of the ordinary flow of intake air (forward flow) is indicated by an arrow 9, and the direction of the backflow is indicated by 8.

When the throttle valve 3 is closed, the forward flow 9 of the idle intake air passes through the first half portion 4*a* of the idle intake passageway in the throttle body 18' and further passes through the cylindrical passageway 23 inside the idle intake regulating valve body 19, then is adjusted in amount by the clearance between the outlet passageway 24 and the idle intake regulating valve 5, then passes through the latter half portion 4*b* of the idle intake passageway in the throttle body 18', flows into the intake chamber 22, and is further sucked into the combustion chamber of the engine.

Under certain operational conditions of the engine, due to the exhaust gas recirculation (EGR) or blowback from the combustion chamber to the intake side, the carbon or other combustion products 6 existing in the intake chamber 22 flow back to the idle intake regulating valve 5 along the direction of the arrow 8 and adhere to and deposit on the surface 5*a* of the idle intake regulating valve 5 and surface 24*a* of the outlet passageway 24 as indicated as 13, whereby the clearance 20 with the idle intake regulating valve 5 is narrowed. Accordingly, there is a possibility of occurrence of error in the control of the flow rate.

Next, the concrete configuration of the fourth embodiment of the present invention for solving this problem will be explained based on FIG. 14. The fundamental configuration of the idle intake control device of the fourth embodiment is substantially the same as that of the related art of FIG. 3, but the configuration of the throttle body 18 is partially different as will be explained later. Note that, also in FIG. 14, 19 is the idle intake regulating valve body connected to the upstream side of the throttle body 18, and 4 is the idle intake passageway provided in the throttle body 18. The first half portion 4*a* and latter half portion 4*b* thereof are respectively connected to the passageways 23 and 24 inside the idle intake regulating valve body 19. Further, 5 is the idle intake regulating valve, and 20 is the clearance formed by the idle intake regulating valve 5 and the passageway 24. These are the same as those of the related art shown in FIG. 3.

As the characteristic feature of the fourth embodiment of the present invention shown in FIG. 14, the outlet passageway 25 opened in the intake chamber 22 is connected to the latter half portion 4*b* of the idle intake passageway 4 so as to intersect with this at right angles. Then, by extending the outlet passageway 25 to the opposite side to the opening 26, an accumulation chamber passageway 27 is formed. An accumulation chamber 28 for accumulating the carbon and other combustion products 6 is provided in communication with this in the direction of gravity, i.e., in this case, downward. Further, metal sphere 29 is accommodated in the accumulation chamber 28 and a dam 30 provided at inlet of the accumulation chamber 28 to prevent the metal sphere 29 from flying out to the accumulation chamber passageway 27.

Here, it is important that the accumulation chamber passageway 27 be formed at a deep elongated location at the opposite side of the opening 26 on an extension of the outlet passageway 25 opened in the intake chamber 22 and that the accumulation chamber 28 exist at a lower position in the direction of gravity. Desirably, the internal volume of the accumulation chamber 27 is set to about ¼ to ⅙ of the outlet passageway 25. As the internal volume of the accumulation chamber 28, desirably the volume of the clearance between the wall surface of the accumulation chamber 28 and the metal sphere 29 is about ⅛ to 1/10 of the outlet passageway 25 in a state where the metal sphere 29 is contained.

Next, an explanation will be made of the operation of the idle intake control device of the fourth embodiment having the configuration shown in FIG. 14. When the intake regulating valve, that is, the throttle valve 3, is closed in the operation state of the engine, the forward flow 9 of the idle intake air passes through the first half portion 4*a* of the idle intake passageway 4 in the throttle body 18, passes through the cylindrical passageway 23 inside the idle intake regulating valve body 19, and then is regulated in amount by the clearance 20 between the outlet passageway 24 and the idle intake regulating valve 5, further passes through the latter half portion 4*b* of the idle intake passageway and outlet passageway 25, and flows from the opening 26 into the intake chamber 22.

Here, as previously mentioned, under some operational conditions, the carbon and other combustion products 6 inside the intake chamber 22 flow back from the opening 26 to the outlet passageway 25 of the idle intake passageway, but according to the fourth embodiment, the backflowing combustion products 6 go straight in the outlet passageway 25 of the idle intake passageway from the internal portion of the intake chamber 22 due to inertia, pass through the accumulation chamber passageway 27, and strike an end wall 31. The combustion products are heavy and have a larger mass per unit volume than air, therefore separate from the air, drop into the accumulation chamber 28, and accumulate there.

As it is, the carbon and other combustion products 6 are apt to attach to the inside of the accumulation chamber 28 and fill the accumulation chamber 28, but the metal sphere 29 is contained inside the accumulation chamber 28 in the fourth embodiment and is prevented from flying out by the dam 30. Accordingly, this metal sphere 29 tumbles inside the accumulation chamber 28 due to the vibration when the engine is operated and pulverizes the fixed combustion products 6. Therefore, the pulverized combustion products 6 are sucked again into the intake chamber 22 while riding on the air pulsatively entering into and leaving the passageway of the accumulation chamber 28 from the accumulation chamber passageway 27. At this time, the particle size of the pulverized combustion products 6 is smaller than that of the combustion products 6 adhered to and deposited on the surface 5*a* of the idle intake regulating valve 5 and the surface 24*a* of the outlet passageway 24 in the related art shown in FIG. 3, therefore does not ride on the weak air flow passing through the passageway bent at right angles and flowing back to the idle intake regulating valve 5 side. Note that desirably the metal sphere 29 is made of stainless steel.

From the above operation, the clearance 20 of the idle intake regulating valve 5 is no longer narrowed due to a deposit 13 formed by deposition on the surface 5*a* of the idle intake regulating valve 5 and the surface 24*a* of the outlet passageway 24. As a result, the possibility of occurrence of error in the control of the flow rate is eliminated.

Figure 15:
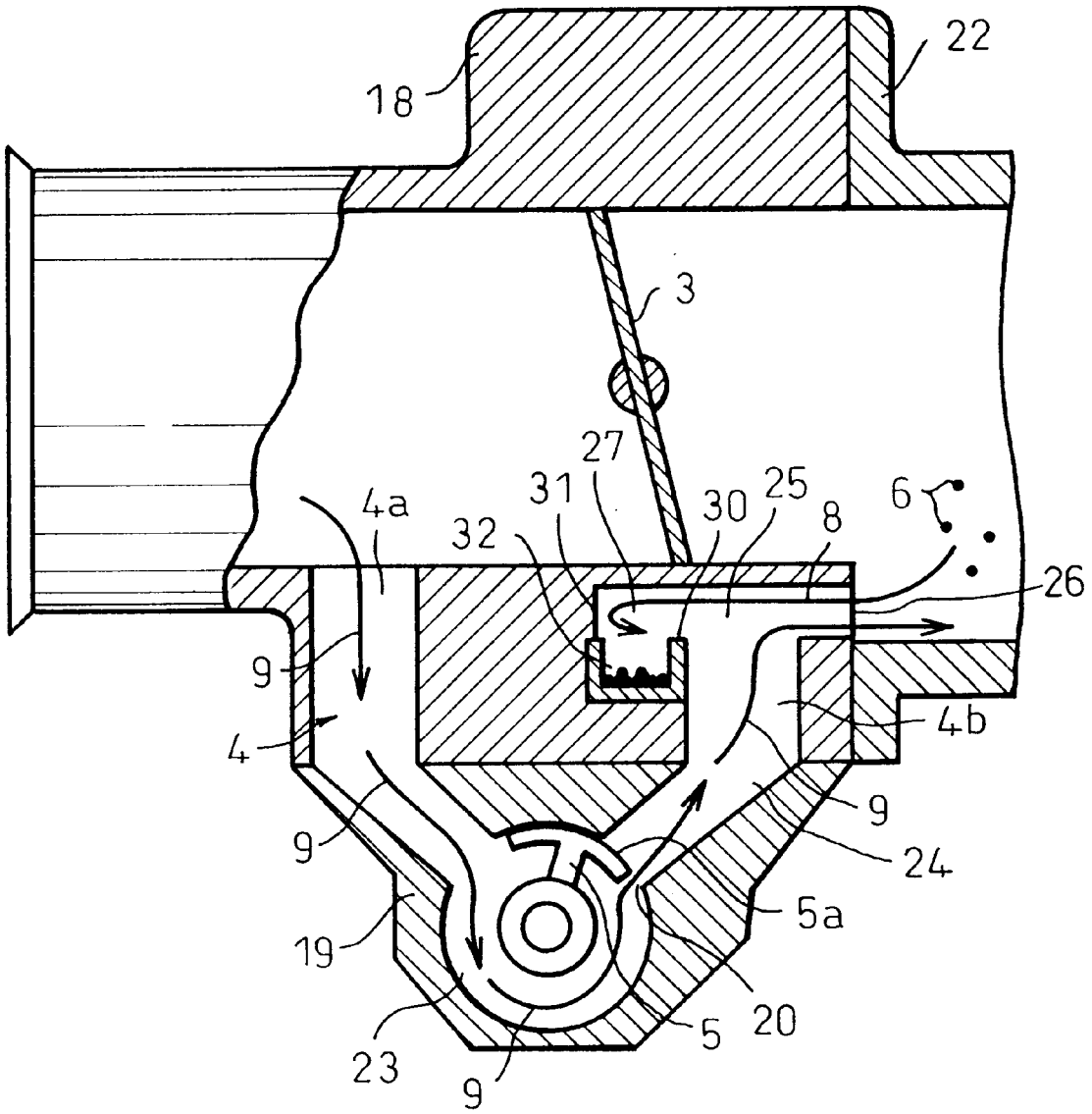
FIG. 15 is a lateral sectional side view of a fifth embodiment of the present invention.

FIG. 15 shows an idle intake control device according to a fifth embodiment of the present invention. The characteristic feature of the fifth embodiment resides in the provision of an accumulation chamber 32 which can be detached sideward like a drawer in place of the metal sphere 29 in the accumulation chamber 28 in the fourth embodiment. The rest of the configuration is the same as that of the fourth embodiment shown in FIG. 14. Accordingly, in the fifth embodiment, it is possible to pull out the accumulation chamber 32 to the outside when the combustion products 6 accumulate in the accumulation chamber 32 so as to remove the combustion products in the accumulation chamber 32. In this case, it is possible to take out the accumulation chamber 32 and clean the inside or to replace it with a new accumulation chamber 32. Note that, in the fifth embodiment shown in FIG. 15, the accumulation chamber 32 is formed as a pull-out type, but needless to say also a screw-in type etc. can be adopted as modifications thereof.

Figure 4:
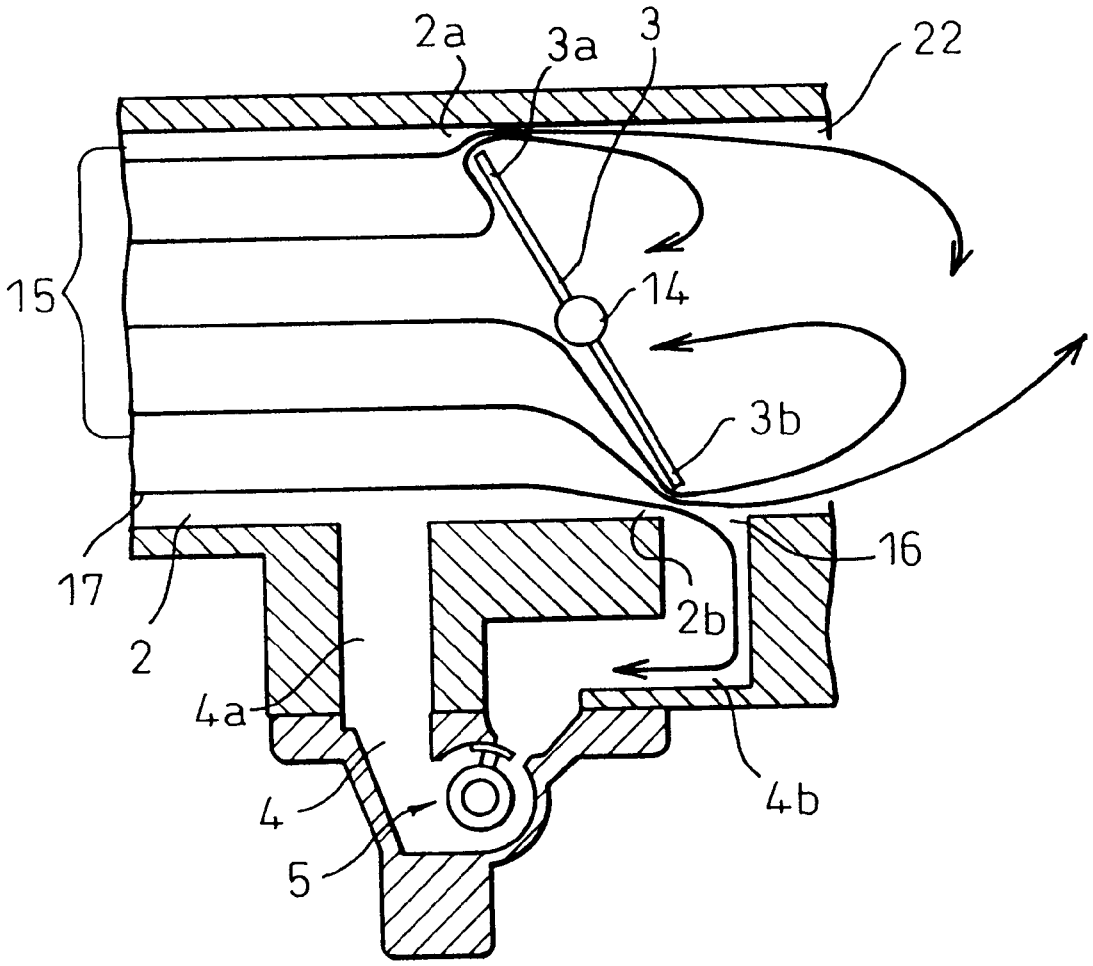
Fig. 4 PRIOR ART
FIG. 4 is a vertical sectional front view of a third related art.
Figure 5:
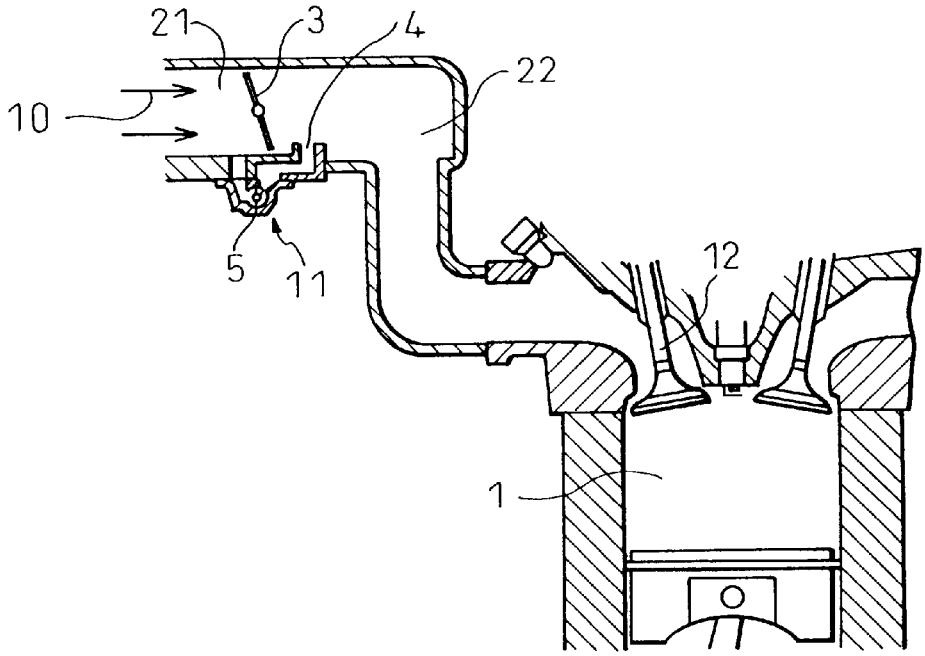
Fig. 5 PRIOR ART
FIG. 5 is a vertical sectional front view of a fourth related art.
Figure 6:
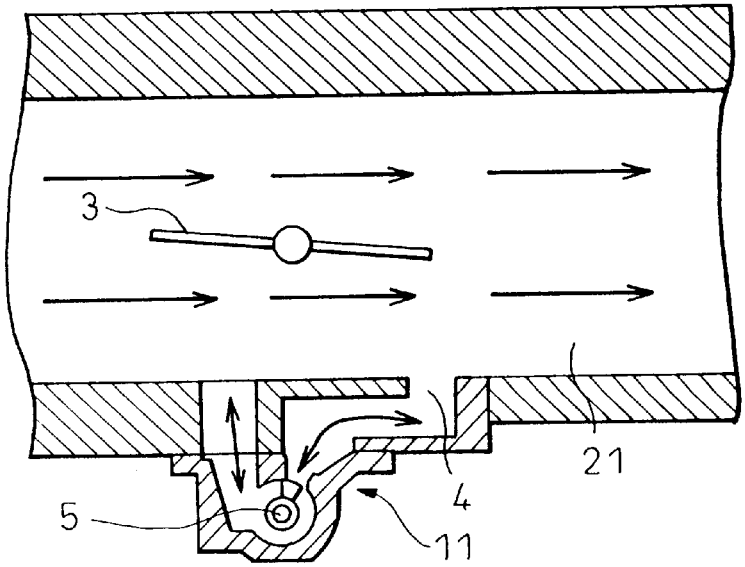
Fig. 6 PRIOR ART
FIG. 6 is a vertical sectional front view of an enlarged part of FIG. 5.
Figure 16:
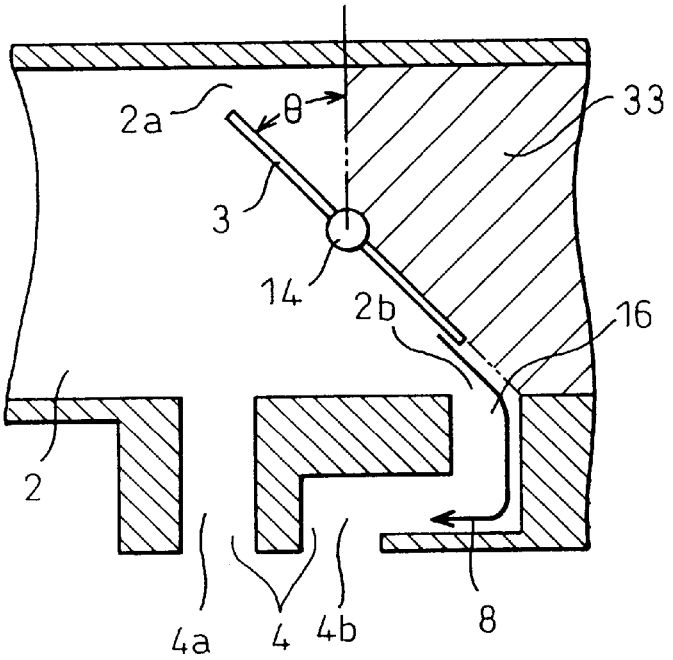
FIG. 16 is a vertical sectional front view for explaining the process for reaching the sixth embodiment of the present invention.
Figure 17:
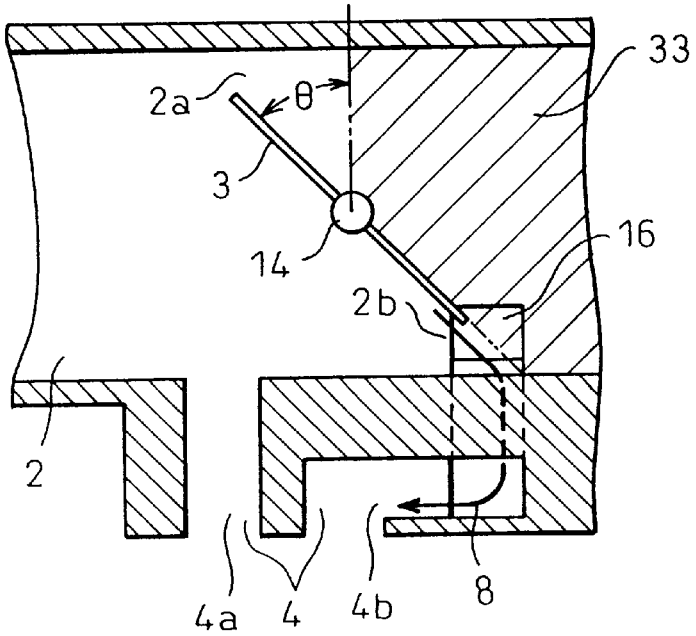
FIG. 17 is a vertical sectional front view similarly explaining the process for reaching the sixth embodiment.

Further, in order to solve the problems in the third related art shown in FIG. 4 explained before, the present inventors engaged in repeated experiments, evaluation, and studies. They consequently found that when the opening 16 is provided at a position whereby the entire opening 16 at the end of the idle intake passageway 4 becomes an upstream side of the throttle valve 3 as shown in FIG. 16 during a period from when the intake regulating valve, e.g., the butterfly type throttle valve 3, starts to open. It opens to when it reaches the "certain valve opening angle θ", a partial backflow 8 of intake air is produced in the idle intake passageway 4 at a valve opening angle of not more than the "certain valve opening angle θ" of the throttle valve 3. During this process, the backflow 8 is still produced even in a state where only about a half of the opening 16 becomes the upstream side of the throttle valve 3 at a "certain valve opening angle θ" by changing the position of the opening 16 on the wall surface of the intake passageway 2 and correcting the position as shown in FIG. 17.

They further found the fact that no substantial backflow 8 was produced any longer if the opening 16 is provided at a position that becomes the upstream side of the throttle valve 3 first when the throttle valve 3 takes a valve opening angle more than the "certain valve opening angle θ". They ascertained that there was a constant relationship between the valve opening angle of the throttle valve 3 for determining whether or not the backflow 8 was produced and the position of the opening 16 in this type of idle intake control device.

They further engaged in repeated experiments and found that the concrete value of the "certain valve opening angle θ" was about 45° in many cases for a butterfly type throttle valve 3. Accordingly, it was clarified that if the opening 16 at the end of the idle intake passageway 4 is provided at a position at the downstream side of the shaft 14 of the throttle valve 3 and in addition reaches the upstream side of the throttle valve 3 first at a valve opening angle of more than the found constant valve opening angle θ, no backflow 8 is substantially produced in the idle intake passageway 4 and that, as indicated as 33 in FIG. 16 and FIG. 17, a "preferred region" could be set in the intake passageway 2 or on the intake chamber 22 for providing the opening 16.

Figure 18:
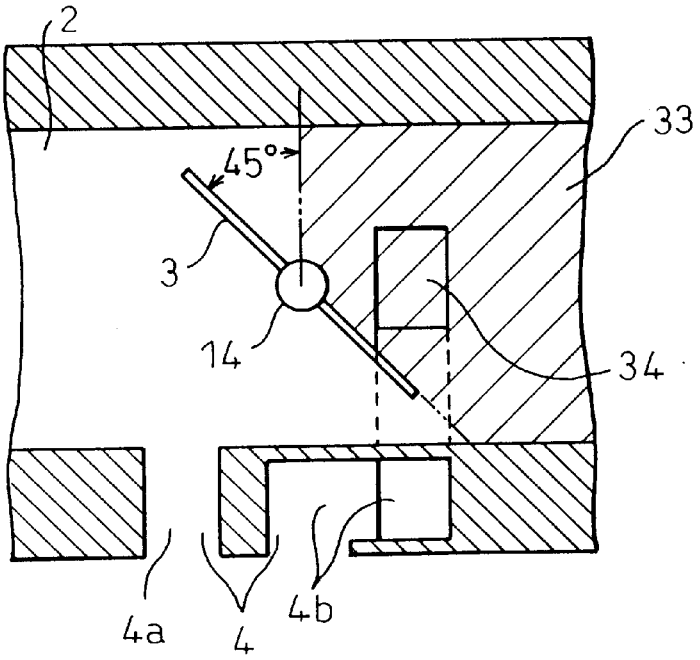
FIG. 18 is a vertical sectional front view of the sixth embodiment of the present invention.
Figure 19:
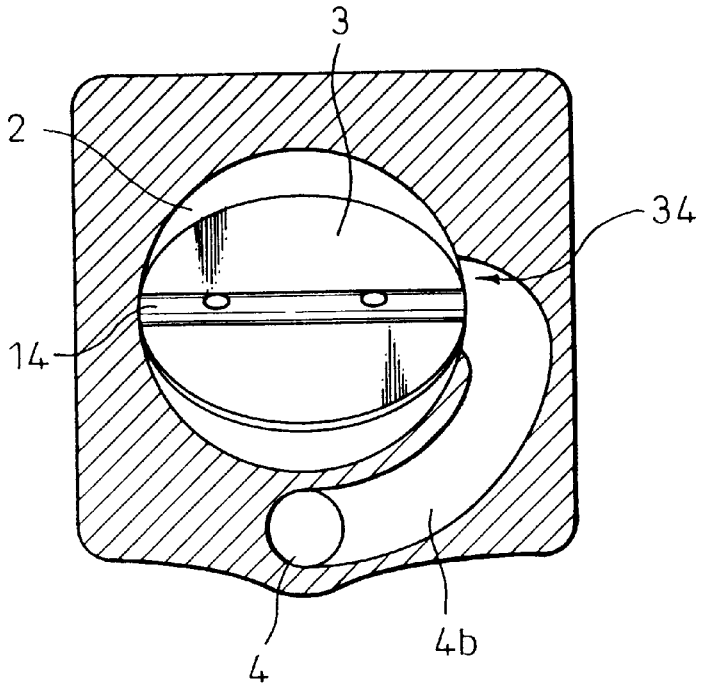
FIG. 19 is a lateral sectional side view of FIG. 18.

FIGS. 18 and 19 show the principal parts of an idle intake control device according to a sixth embodiment of the present invention. The same reference numerals are assigned to the constituent parts in the figure substantially the same as those of the idle intake control device explained before and overlapping explanations of them will be omitted.

The characteristic feature of the sixth embodiment resides in that, in a state where the throttle valve 3 takes the valve opening angle of 45° as the constant valve opening angle θ corresponding to the "certain valve opening angle θ" of the meaning explained before, the position of the opening 34 where the end at the downstream side of the bypass passageway of the throttle valve 3, that is, the idle intake passageway 4, opens to the intake passageway 2 is made the wall part of the intake passageway 2 in the "suitable region 33" defined as the wall part of the intake passageway 2 at the downstream side of the plane of the butterfly type throttle valve 3 and downstream of the shaft 14 of the throttle valve 3. For this reason, the part 4*b* at the downstream side of the idle intake passageway 4 is slightly moved in the circumferential direction of the intake passageway 2.

In the sixth embodiment, by extending the part 4*b* at the downstream side of the idle intake passageway 4 in the circumferential direction of the intake passageway 2, the opening 34 of the end is provided at a position that becomes the downstream side of the throttle valve 3 in a state where the throttle valve 3 takes a constant valve opening angle 45° and the downstream side of the shaft 14 of throttle valve 3, so due to the above nature in this type of idle intake control device found by the present inventors, no backflow of intake air is produced in the idle intake passageway 4. Accordingly, the combustion products are no longer carried to the idle intake regulating valve 5 by the backflow of the intake (refer to FIG. 4) and there is no fear that the adhesion of combustion products will cause a deterioration of the controllability of the idle intake regulating valve 5.

Figure 20:
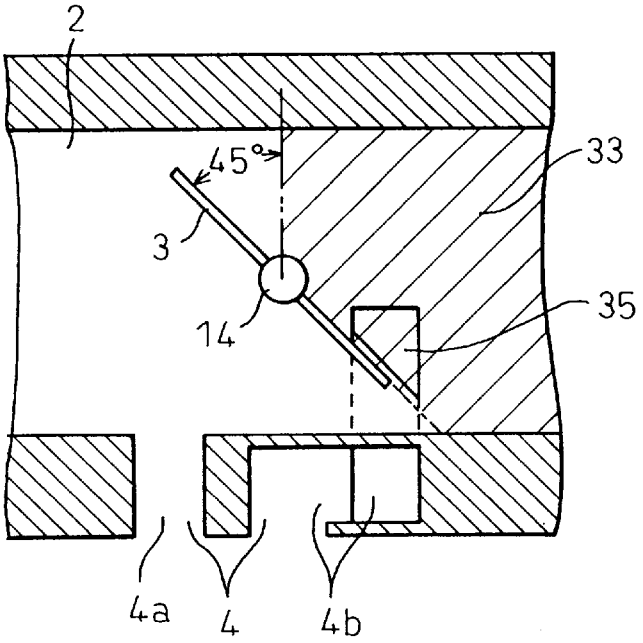
FIG. 20 is a vertical sectional front view of a seventh embodiment of the present invention.
Figure 21:
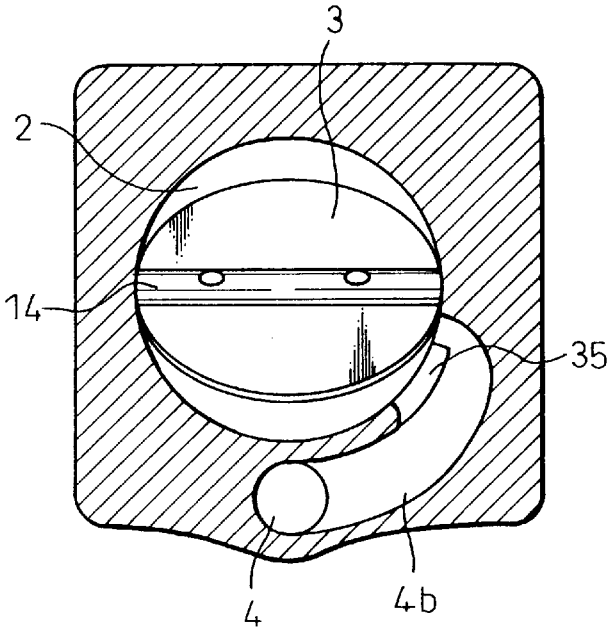
FIG. 21 is a lateral sectional side view of FIG. 20.

FIG. 20 and FIG. 21 show the principal parts of an idle intake control device as a seventh embodiment of the present invention. The characteristic feature of the seventh embodiment resides in that when the throttle valve 3 takes a valve opening angle of 45° as the constant valve opening angle θ in the sixth embodiment shown in FIG. 18, to prevent even part of the opening 34 from appearing at the upstream side of the throttle valve 3, the opening 34 is deformed to make a trapezoidal opening 35 following along the throttle valve 3 and opening only in the preferred region 33. By deforming the shape of the opening 35 along the throttle valve 3 in this way, the functional effect of the present invention can be sufficiently exhibited while keeping the length of the part 4*b* at the downstream side of the idle intake passageway 4 relatively short. Note that the other points are similar to those of the sixth embodiment, therefore the idle intake control device of the seventh embodiment shown in FIG. 20 and FIG. 21 exhibits similar functional effects to those of the sixth embodiment shown in FIG. 18 and FIG. 19.

Figure 22:
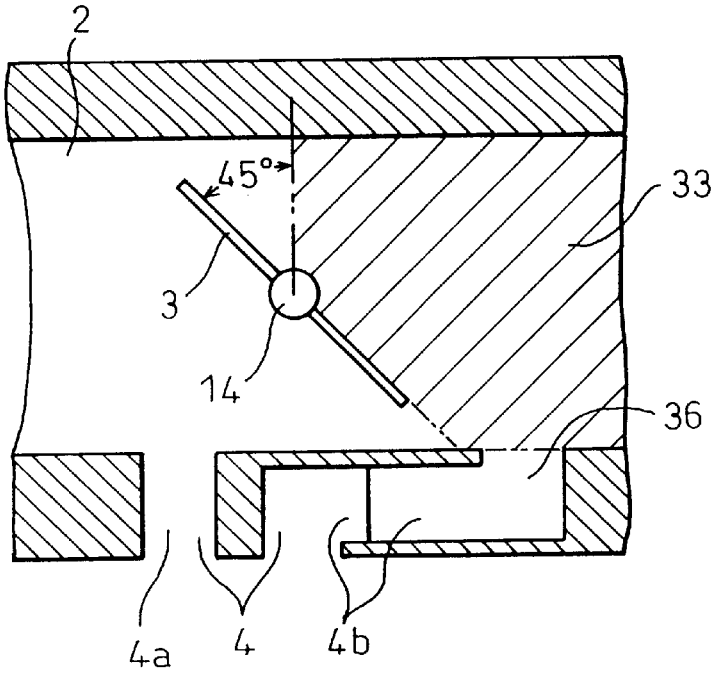
FIG. 22 is a vertical sectional front view showing an eighth embodiment of the present invention.
Figure 23:
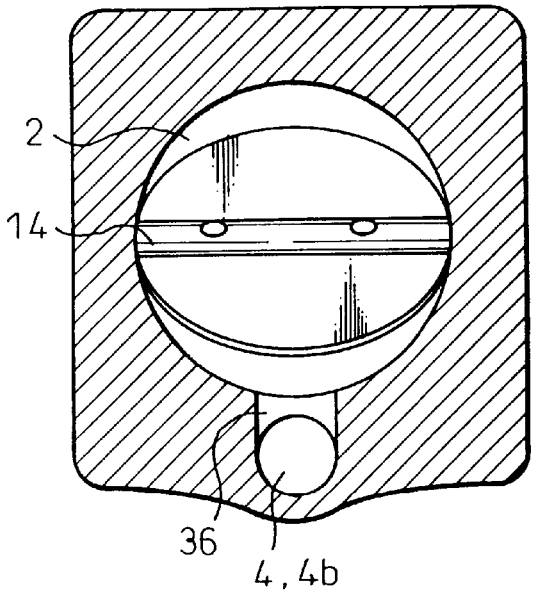
FIG. 23 is a lateral sectional side view of FIG. 22.

FIG. 22 and FIG. 23 show principal parts of the idle intake control device according to an eighth embodiment of the present invention. The characteristic feature of the eighth embodiment resides in that the length of the part 4*b* on the downstream side of the idle intake passageway 4 is make long in the axial line direction of the intake passageway 2 so as to set the position of the opening 36 to sufficiently the downstream side from the throttle valve 3. Even when the throttle valve 3 takes the "certain valve opening angle θ", that is, a valve opening angle of 45°, the opening 36 is prevented from becoming positioned at the upstream side of the throttle valve 3. If the position of the opening 36 is set at a sufficiently downstream side point from the throttle valve 3 in this way, the entire circumference of the intake passageway 2 at that point enters into the preferred region 33, therefore the opening 36 can be provided at any position in the entire circumference.

Figure 24:
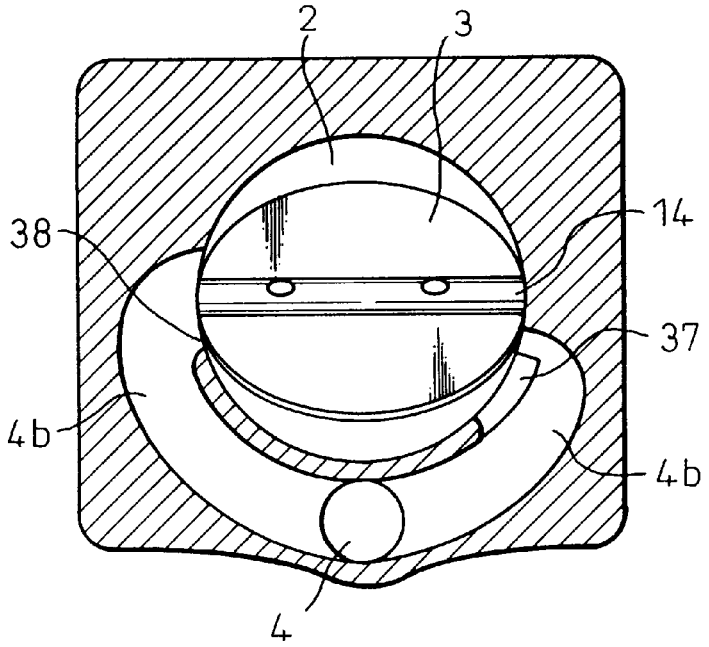
FIG. 24 is a lateral sectional side view of a ninth embodiment of the present invention.

FIG. 24 shows the principal parts of an idle intake control device according to a ninth embodiment of the present invention. The characteristic feature of the ninth embodiment resides in that the part 4*b* on the downstream side of the idle intake passageway 4 is branched to provide two idle intake passageways around the intake passageway 2 and in that two end openings are formed. Needless to say both of the two openings 37 and 38 are provided in the preferred region 33. In this case as well, it is more advantageous if the openings 37 and 38 are provided close to the throttle valve 3, so the shape of at least one of the openings 37 and 38 can be made trapezoidal.

Figure 25:
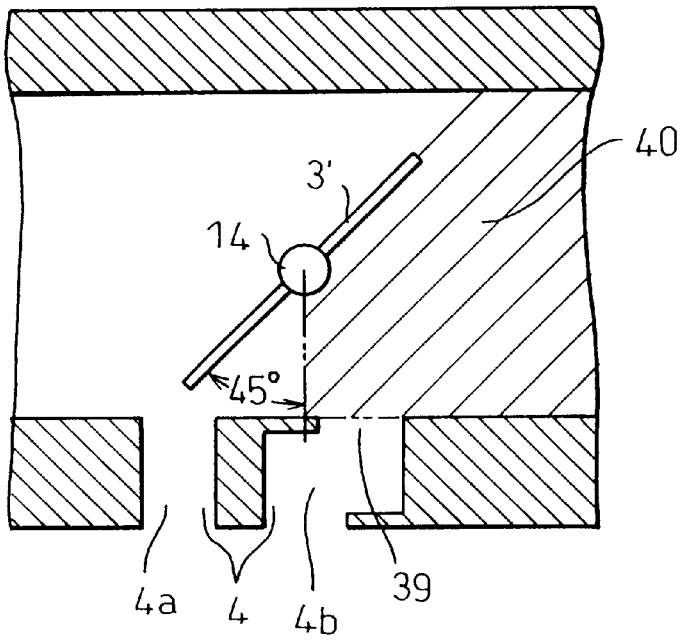
FIG. 25 is a vertical sectional front view of a 10th embodiment of the present invention.

FIG. 25 shows the principal parts of an idle intake control device according to a 10th embodiment of the present invention. The characteristic feature of the 10th embodiment resides in that the pivoting range of the throttle valve 3' becomes reverse to those shown in the above embodiments. Accordingly, the preferred region 40 for providing the opening 39 at the downstream side of the idle intake passageway 4 has a different shape from that of the region 33, but according to the 10th embodiment, it becomes possible to provide the opening 39 at a position closer to the shaft 14 of the throttle valve 3'. Therefore the length of the part 4*b* at the downstream side of the idle intake passageway 4 can be shortened. Note that the lateral sectional side view of the 10th embodiment resembles FIG. 23, so the lateral sectional side view is omitted here. Further, the functional effects of the 10th embodiment are substantially the same as those of the above embodiments.

Figure 26:
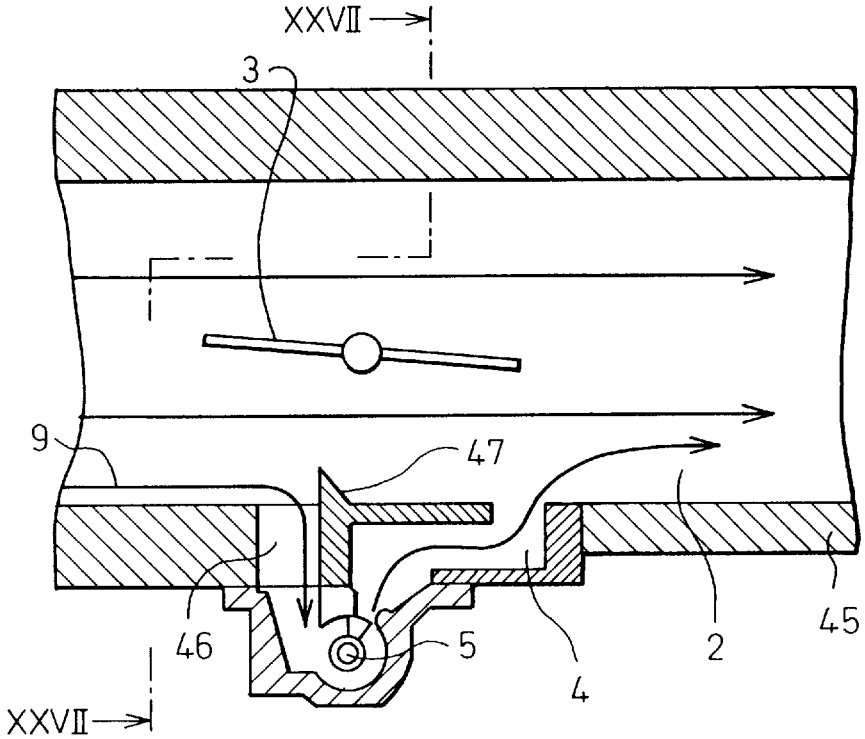
FIG. 26 is a vertical sectional front view of an 11th embodiment of the present invention.
Figure 27:
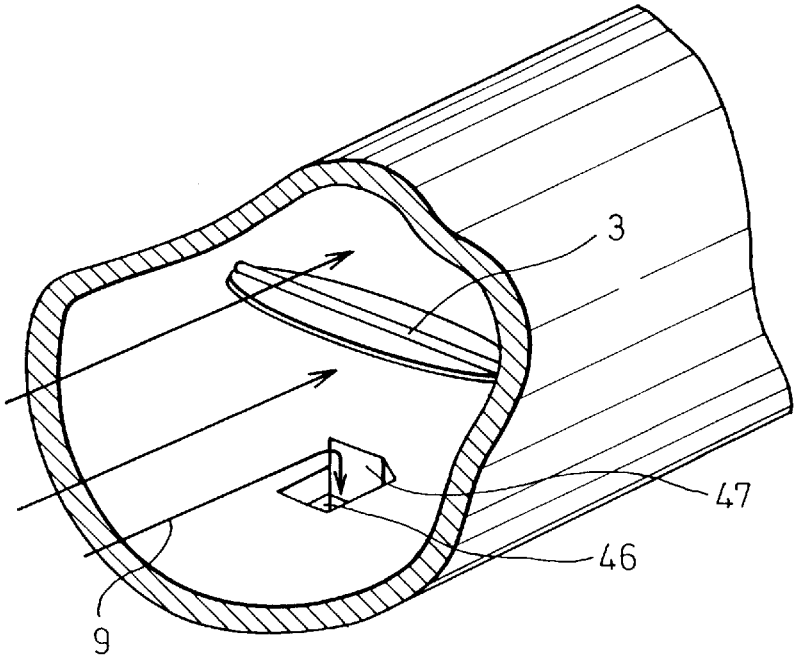
FIG. 27 is a perspective view of a lateral cross section of a 12th embodiment.

FIG. 26 and FIG. 27 show an 11th embodiment of the present invention. In FIG. 26, the main intake regulating valve, that is, the throttle valve 3, for adjusting the amount of intake air fed to the not illustrated engine is disposed in the intake pipe 45 forming the main intake passageway 2. The intake air flows in the intake pipe 45 left to right in the figure, passes through the throttle valve 3, and then is sucked into the engine through the passageway in the not illustrated intake chamber.

An idle intake passageway 4 having a schematically U-shape connecting the upstream side and downstream side of the throttle valve 3 is formed in the wall of the intake pipe 45 in the vicinity of the throttle valve 3. The idle intake regulating valve 5 is disposed in the intermediate portion of the idle intake passageway 4. The amount of intake air at the time of idling is adjusted by adjusting the degree of opening thereof.

As shown in FIG. 27, an opening 46 acting as the intake inlet to the idle intake passageway 4 is formed in the wall of the intake pipe 45. The opening portion 46 has a rectangular shape. A standing wall 47 standing inside of the intake pipe 45 is provided at one side on the downstream side thereof. Part of the intake is guided into the idle intake passageway 4 along this. At this time, preferably the standing wall 47 is provided at an inclination so that the surface of the upstream side receiving the flow of intake air faces vertically the flow of the intake air or the front end of the standing wall faces the upstream side. It effectively guides the intake air to the idle intake passageway 4.

According to the above configuration, even in the state of FIG. 26 where the throttle valve 3 is fully open, it is possible to make part of the flow of intake air in the intake pipe 45 with the standing wall 47, change in orientation downward and guide this from the opening portion 46 in the idle intake passageway 4 (refer to FIG. 27). Accordingly, a forward direction flow 9 going from the upstream side to downstream side in the idle intake passageway 4 is always formed, so the combustion products of the engine can be prevented from intruding from the outlet side of the idle intake passageway 4. Accordingly, it is possible to prevent the combustion products from flowing back in the idle intake passageway 4, reaching the idle intake regulating valve 5, and adhering to the same.

Here, the shape of the opening portion 46 is not limited to a rectangular shape and can be another shape. Further, also the position of formation and shape of the standing wall 47 can be appropriately changed in accordance with the shape of the opening portion 46. For example, it is also possible to make the shape of the opening portion 46 circular and form an arc-shaped standing wall (not illustrated) standing from the edge portion at the downstream side of the same and to obtain a similar effect.

Figure 28:
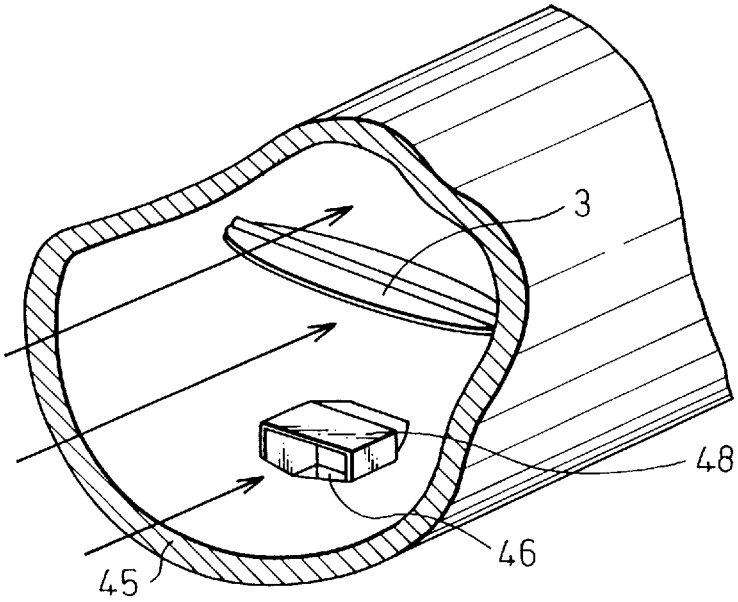
FIG. 28 is a perspective view of a lateral cross section of a 12th embodiment of the present invention.

FIG. 28 shows a 12th embodiment of the present invention. In the 12th embodiment, a box type wall part 48 covering the rectangularly shaped opening portion 46 from above is provided in place of the standing wall 47. This wall portion 48 is projected upward from the edge portion of the opening portion 46 except one side on the upstream side and covers the sides and top of the opening portion 46. The end surface at the upstream side of the box type wall portion 48 is opened and constituted so as to guide part of the intake air into the internal portion from the opening.

Also, by the above configuration, it is possible to guide part of the flow of intake air in the intake pipe 45 from the upstream side opening of the wall portion 48 to the internal portion thereof and guide this into the idle intake passageway 4. Accordingly, it is possible to always form a forward direction flow in the idle intake passageway 4 and prevent the invasion of the combustion products of the engine. Further, in the 12th embodiment, the wall portion 48 is provided not only at the edge portion at the downstream side of the opening portion 46, but also at the side and top edge portions, therefore the air convergence effect is large and a higher effect is obtained.

Note that the shape of the wall portion 48 is not limited to the illustrated shape and may be a shape that has an opening only on the upstream side, covers the opening portion 46 from above, and is able to guide the intake air in the direction of the idle intake passageway 4.

Figure 29:
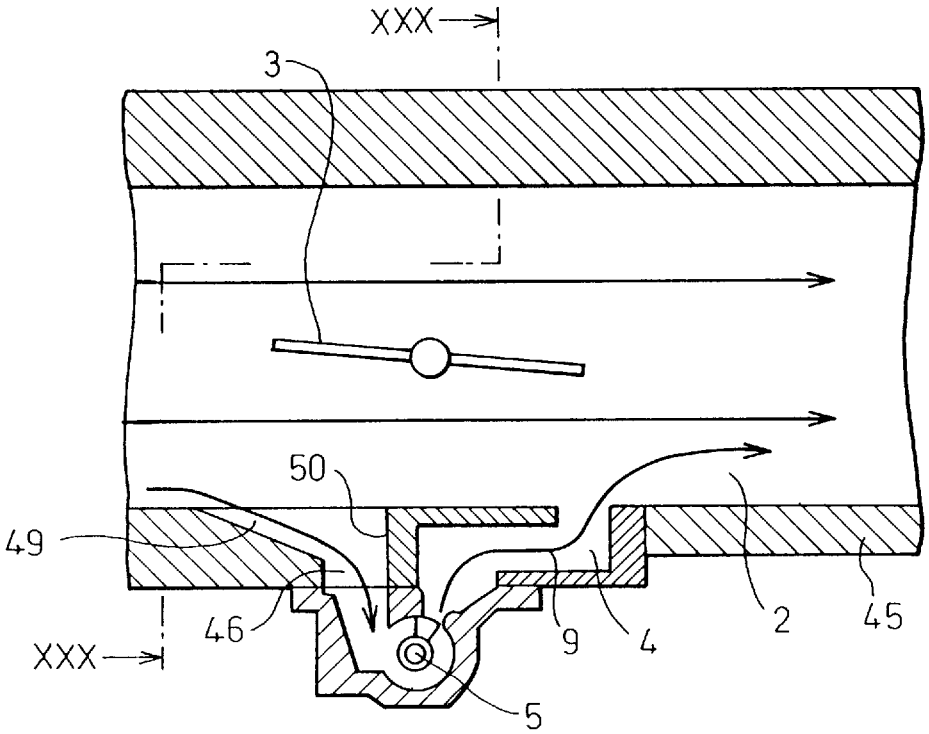
FIG. 29 is a vertical sectional front view of a 13th embodiment of the present invention.
Figure 30:
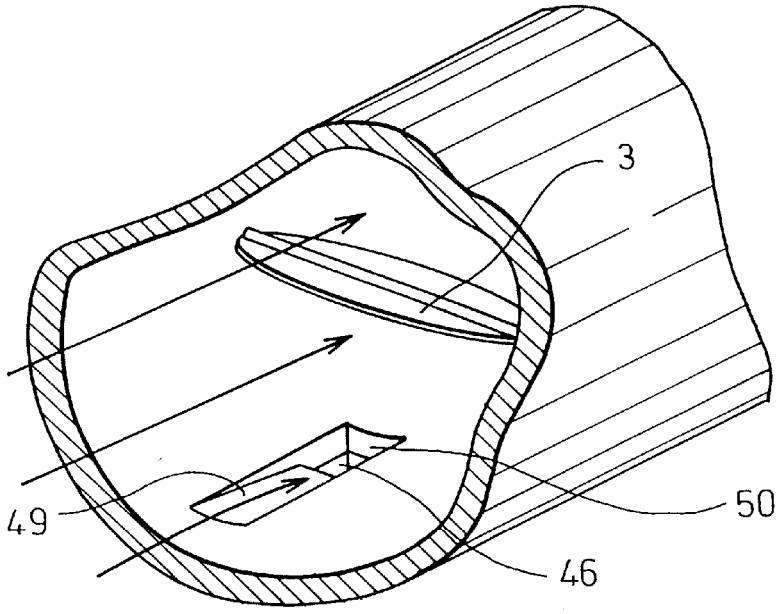
FIG. 30 is a perspective view of a lateral cross section of the 13th embodiment.

FIGS. 29 and 30 show a 13th embodiment of the present invention. In the 13th embodiment, the pipe wall of the intake pipe 45 at the upstream side is formed so as to be inclined downward toward the opening portion 46 acting as the intake inlet to the inside of the idle intake passageway 4. Also, a concave portion 49 of a substantially triangular cross section is formed at the upstream side of the opening portion 46. At this time, the opening portion 46 is located at the bottom portion of the concave portion 49. Further, a standing wall 50 vertically standing in the intake pipe 45 from the edge portion is formed at one side at the downstream side of the rectangular opening portion 46.

In the above configuration, part of the flow of intake air in the intake pipe 45 is guided to the downward inclined concave portion 49 and branched to flow toward the opening portion 46. Further, it strikes the vertical standing wall 50 formed at the downstream side of the opening portion 46, changes in direction downward, and is introduced to the idle intake passageway 4. Accordingly, even by the above configuration, a forward direction flow 9 is always formed in the idle intake passageway 4, therefore a similar effect of preventing the invasion of the combustion products of the engine is obtained.

Note that, in the present embodiment, since the direction of the intake air can be changed by the concave portion 49, it is not always necessary to provide the vertical standing wall 50, but the effect of guiding the intake air can be raised by the combination of the two.

Figure 31:
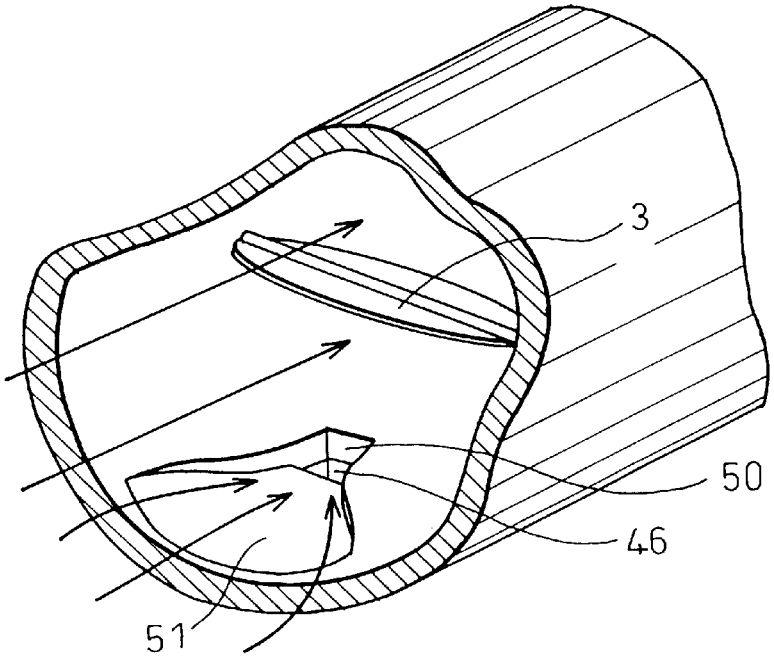
FIG. 31 is a perspective view of a lateral cross section of a 14th embodiment of the present invention.

FIG. 31 shows a 14th embodiment of the present invention. In the 14th embodiment, by changing the shape of the inclined surface of the concave portion 49 in the 13th embodiment, a concave portion 51 shaped so that the surface area becomes greater toward the upstream side is formed. The configuration providing the opening portion 46 in the bottom portion of the concave portion 51 and forming the standing wall 50 at the downstream side thereof is similar to that of the 13th embodiment.

According to the configuration of the 14th embodiment, by increasing the surface area at the upstream side of the concave portion 51, a larger amount of intake air can be guided into the concave portion 51. Accordingly, the amount of intake air flowing in the idle intake passageway 4 is increased and the invasion of the combustion products of the engine can be more reliably prevented.

As described above, according to the present invention, by preventing the backflow of intake air in the idle intake passageway 4 and always forming a forward direction flow near the idle intake regulating valve 5, it is possible to prevent the invasion of combustion products and backflow and prevent the adhesion of the combustion products to the idle intake regulating valve 5.

While the invention has been described with reference to specific embodiments chosen for purposes of illustration, it should be apparent that numerous modifications could be made thereto by those skilled in the art without departing from the basic concept and scope of the invention.

What is claimed is:

1. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein said backflow preventing means is a restrictor portion provided in said idle intake passageway at the downstream side of said idle intake regulating valve, and an inner wall surface of the restrictor portion and an inner wall surface of said idle intake passageway at the upstream side and downstream side thereof are connected by a smooth surface with no step differences.

2. An idle intake control device according to claim 1, wherein said restrictor portion is shaped so that its diameter is smoothly and gradually increased from substantially a center minimum diameter portion toward the upstream side and downstream side.

3. An idle intake control device according to claim 2, wherein an angle of inclination of an inner wall surface at an upstream side of said minimum diameter portion is made larger than the angle of inclination of the inner wall surface at a downstream side in said restrictor portion.

4. An idle intake control device according to claim 1, wherein a passageway sectional area of said minimum diameter portion is set to 80% or less of the smaller passageway sectional area between passageway sectional areas of said idle intake passageway at the upstream side and downstream side thereof and, in addition, more than the maximum opening area of said idle intake regulating valve.

5. An idle intake control device according to claim 2, wherein the position of said minimum diameter portion is set so that the distance x [mm] of the center trace of the passageway cross section from said minimum diameter portion to the downstream side end of said idle intake passageway becomes equal to or larger than $1.5 \cdot \Delta p$ where the maximum intake pulsation width in said intake passageway at the downstream side of said intake regulating valve is defined as Δp[kPa].

6. An idle intake control device according to claim 1, wherein the entire passageway inner wall surface of said idle intake passageway at the downstream side of said idle intake regulating valve is constituted by a smooth surface not having a step difference and angle portion.

7. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein an accumulation chamber capable of accumulating carbon and other combustion products is provided as said backflow preventing means to the outlet opening of said idle intake passageway at the downstream side of the idle intake regulating valve for opening and closing said idle intake passageway for adjusting the idling speed.

8. An idle intake control device according to claim 7, wherein said accumulation chamber is provided in the form of a lateral hole or vertical hole on an extension of said outlet passageway and opposite to the outlet opening of said outlet passageway when seen from the convergence point of the outlet from said idle intake regulating valve provided in said outlet passageway so as to converge from the lateral direction.

9. An idle intake control device according to claim 7, wherein said accumulation chamber is given a volume of 1/10 to 1/8 of the entire passageway volume of the idle intake control device.

10. An idle intake control device according to claim 7, wherein a metal sphere which can freely tumble in said accumulation chamber is accommodated in the chamber so as to pulverize the carbon and other combustion products accumulated in said chamber and cause them to be sucked into the intake chamber again.

11. An idle intake control device according to claim 7, wherein said accumulation chamber in which carbon and other combustion products are accumulated can be detached and replaced with a new accumulation chamber in which carbon and other combustion products are not accumulated.

12. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein said backflow preventing means is said outlet opening, said outlet opening being provided at a position that becomes a downstream side of said intake regulating valve when said intake regulating valve takes a constant valve opening angle of a limit not causing a backflow in said idle intake passageway.

13. An idle intake control device according to claim 12, wherein the constant valve opening angle of a limit not causing a backflow in said idle intake passageway taken by said intake regulating valve is a valve opening angle obtained by rotation of exactly substantially 45° when seen from the fully closed position of said intake regulating valve and the opening position of said opening of the end of said idle intake passageway is located at the downstream side of the shaft of said intake regulating valve.

14. An idle intake control device according to claim 12, wherein said opening is shaped deformed along said intake regulating valve so as to provide said opening of the end of the idle intake passageway in a preferred region defined as a range of positions which become the downstream side of said intake regulating valve when said intake regulating valve takes a constant valve opening angle of a limit not causing a backflow in said idle intake passageway.

15. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein an opening portion acting as the intake inlet to said idle intake passageway is provided in the wall surface of said intake passageway at the upstream side of said intake regulating valve and a standing wall, the standing wall being projected from an edge portion at the downstream side of said opening portion toward an interior of said intake passageway and guides part of the intake air flowing in said intake passageway into said idle intake passageway, is provided as said backflow preventing means.

16. An idle intake control device according to claim 15, wherein said standing wall is arranged so as not to be parallel to the flow of intake air in said intake passageway.

17. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein an opening portion acting as the intake inlet to said idle intake passageway is provided in a wall surface of said intake passageway at the upstream side of said intake regulating valve and a wall portion, the wall portion being projected from an edge portion of said opening portion except part of the upstream side of said opening portion toward an interior of said intake passageway covers sides and a top portion of the downstream side of said opening portion and guides part of the intake air flowing in said intake passageway into said idle intake passageway, is provided as said backflow preventing means.

18. An idle intake control device of an internal combustion engine comprising:

an idle intake passageway for connecting an upstream side and downstream side of an intake regulating valve provided in the intake passageway of said engine so as to pass idle intake air for idling of the engine;

an idle intake regulating valve provided in a middle section of the idle intake passageway to regulate the flow rate of the idle intake air passing through the idle intake passageway and fed to said engine; and at least one backflow preventing means, said backflow preventing means (i) positioned in the vicinity of said idle intake regulating valve, and (ii) for preventing backflow of the idle intake air in said idle intake passageway without substantially preventing the flow of the idle intake air and producing only a forward flow of idle intake air near said idle intake regulating valve so as to prevent the idle intake air existing near an outlet opening of said idle intake passageway from flowing back in said idle intake passageway accompanied by combustion products, reaching said idle intake regulating valve, and causing combustion products to adhere to said idle intake regulating valve;

wherein a concave portion inclined downward toward the downstream side is formed in a wall surface of said intake passageway at the upstream side of said intake regulating valve and an opening portion acting as an intake inlet to said idle intake passageway is provided in a bottom portion of the concave portion.

19. An idle intake control device according to claim 18, wherein the width of the inclined surface of said concave portion is made greater toward the upstream side.

* * * * *